US008123517B2

(12) United States Patent
Peruch

(10) Patent No.: US 8,123,517 B2
(45) Date of Patent: Feb. 28, 2012

(54) AUTOMATIC DEVICE FOR THE IGNITION AND CONTROL OF A GAS APPARATUS AND RELATIVE DRIVING METHOD

(75) Inventor: Lino Peruch, Vittorio Veneto (IT)

(73) Assignee: Sit La Precisa, S.p.A., Padua (IT)

( * ) Notice: Subject to any disclaimer, the term of this patent is extended or adjusted under 35 U.S.C. 154(b) by 209 days.

(21) Appl. No.: 11/981,583

(22) Filed: Oct. 30, 2007

(65) Prior Publication Data

US 2009/0035710 A1 Feb. 5, 2009

(30) Foreign Application Priority Data

Jul. 31, 2007 (EP) ..... 07425487

(51) Int. Cl.
*F23N 5/02* (2006.01)

(52) U.S. Cl. ..... 431/12; 431/18; 431/25; 431/42

(58) Field of Classification Search ..... 431/12, 431/18, 25, 89, 90, 42–48; 700/209, 289
See application file for complete search history.

(56) References Cited

U.S. PATENT DOCUMENTS 3,954,383 A * 5/1976 Bryant ..... 431/24
4,000,961 A * 1/1977 Mandock ..... 431/2
4,122,327 A * 10/1978 Vogts et al. ..... 219/121.36
4,303,385 A * 12/1981 Rudich et al. ..... 431/70
4,346,055 A * 8/1982 Murphy et al. ..... 422/54
4,349,148 A * 9/1982 Liberto et al. ..... 236/11
4,519,771 A * 5/1985 Six et al. ..... 431/25
4,552,528 A * 11/1985 Gaiffier ..... 431/25
4,696,639 A * 9/1987 Bohan, Jr. ..... 431/59
4,871,307 A * 10/1989 Harris et al. ..... 431/25
4,984,981 A * 1/1991 Pottebaum ..... 431/80
5,051,089 A * 9/1991 Jayaram ..... 431/80
(Continued)

FOREIGN PATENT DOCUMENTS

DE 195 09 797 C1 6/1996
(Continued)

OTHER PUBLICATIONS

European Search Report, European Patent Office, Appl. No. EP 07 42 5487, Dec. 14, 2007 (2 pp).

*Primary Examiner* — Steven B McAllister
*Assistant Examiner* — Desmond Peyton
(74) *Attorney, Agent, or Firm* — Kevin D. Jablonski; Graybeal Jackson LLP

(57) ABSTRACT

An automatic system and method to provide the ignition and monitoring of a pilot flame for gas burners. The circuit includes a microcontroller that acts on at least one gas valve, a flame igniter, and a flame detector circuits. The valve driver is a switching circuit able to open the valve and keep it open with power saving. The flame detection uses the ionization principle with full use of the rectification property of a flame. Furthermore the flame detection is activated for reduced times to save power. The microcontroller governs the system according to the signals that it receives from points of the circuit. The system provides a circuit realizing advanced power saving techniques to provide also a long term operation on battery powered systems. In addition the automatic control can save gas resources versus traditional thermocouple based systems by applying the intermittent pilot ignition.

29 Claims, 9 Drawing Sheets

U.S. PATENT DOCUMENTS

| | | | | | |
|---|---|---|---|---|---|
| 5,256,057 | A | * | 10/1993 | Grow | 431/79 |
| 5,403,183 | A | * | 4/1995 | Andersson et al. | 431/74 |
| 5,450,841 | A | * | 9/1995 | Whitaker et al. | 126/512 |
| 5,539,672 | A | * | 7/1996 | Mullin et al. | 700/299 |
| 5,577,905 | A | * | 11/1996 | Momber et al. | 431/66 |
| 5,722,823 | A | * | 3/1998 | Hodgkiss | 431/43 |
| 5,899,683 | A | * | 5/1999 | Nolte et al. | 431/25 |
| 5,931,655 | A | * | 8/1999 | Maher, Jr. | 431/14 |
| 5,969,617 | A | * | 10/1999 | Garthe | 340/579 |
| 6,033,211 | A | * | 3/2000 | Meyer | 431/329 |
| 6,056,000 | A | * | 5/2000 | Santacatterina et al. | 137/1 |
| 6,261,087 | B1 | * | 7/2001 | Bird et al. | 431/80 |
| 6,324,046 | B1 | * | 11/2001 | Kadah | 361/166 |
| 6,354,830 | B1 | * | 3/2002 | de Nanclares | 431/80 |
| 6,537,059 | B2 | * | 3/2003 | Lochschmied | 431/12 |
| 2003/0143503 | A1 | * | 7/2003 | Wild et al. | 431/69 |

FOREIGN PATENT DOCUMENTS

| | | | | |
|---|---|---|---|---|
| EP | 47810 | A1 | * | 3/1982 |
| EP | 1 070 919 | A | | 1/2001 |
| EP | 1070919 | A2 | * | 1/2001 |
| EP | 1 394 469 | A | | 3/2004 |
| GB | 207566 | A | * | 11/1981 |
| GB | 2075660 | A | * | 11/1981 |

* cited by examiner

AUTOMATIC DEVICE FOR THE IGNITION AND CONTROL OF A GAS APPARATUS AND RELATIVE DRIVING METHOD

PRIORITY CLAIM

This application claims priority from European patent application No. 07425487.1, filed Jul. 31, 2007, which is incorporated herein by reference.

TECHNICAL FIELD

An embodiment of the present invention relates to an automatic device for the ignition and control of a gas apparatus equipped with at least one burner and with electrically controlled valve means for regulating the flow of gas from a main pipe towards a nozzle associated with said at least one burner.

The automatic device being supplied by at least one supply voltage provided by the electricity main and/or by battery means, being coupled to a ground terminal and comprising:

a spark circuit suitable for generating a pilot flame upon receipt a start signal.

An embodiment of the present invention also relates to a driving method of an automatic device for the ignition and control of a gas apparatus.

An embodiment of the invention concerns, in particular but not exclusively, a device for gas apparatuses like for example fires, stoves and gas braziers and the following description refers to this field of application with the sole purpose of simplifying its explanation.

BACKGROUND

As known, gas fireplaces, gas stoves and gas braziers are ignited by an electromechanical ignition device, generally activated by a user, which allows the ignition of a pilot flame at a pilot burner as well as its supervision to ensure that the pilot flame acts as an ignition source for a burner of greater thermal power.

There are suitable valve means for regulating the gas coupled with the ignition device, arranged between the main pipe for the gas and the burners, which are subjected to a thermocouple.

The thermocouple, heated by the flame of the burner, electromechanically monitors the permanent ignition state of the flame. Therefore, possible flame extinction determines a cooling down of the thermocouple and, consequently, the closure of the gas supply to the burner.

In such apparatuses, it is easy to verify if the flame has been extinguished or lost, since it is generally due to a gust of air, a jump in the flue draft, a simple exhaustion of the gas, or similar anomalies.

Therefore, the flame is constantly monitored in the burner in order to avoid damage and dangerous gas leaks. The electromechanical monitoring, by thermocouple, although advantageous from various points of view, has the drawback that the gas supply is not shut off immediately, but occurs only after the cooling of the thermocouple itself. Therefore, there is a danger of the gas escaping without being burnt for a certain period of time before being turned off.

Moreover, during the initial flame ignition step, the user performs a direct manual action in the vicinity of the burner to keep the flame active for a time necessary to heat up the thermocouple. This manual action is risky for the user.

In order to avoid these drawbacks, in recent apparatuses the thermocouples are regulated by special devices that automatically check for the presence of a flame during the ignition step of the gas apparatuses.

Such automatic devices are also supplied by electricity main and by battery means or buffer batteries allowing the apparatuses on which they are installed to operate when the electricity main is not feeding.

Usually the apparatuses, like for example gas fires, are used at locations where there is not a constant supply of electrical power, but rather where the electrical supply varies unpredictably.

Automatic devices with thermocouples are substantially high-energy-consumption devices since they require a high current to maintain the main flow of gas, during the automatic ignition step, to support the flow of gas during the heating step of the thermocouple, and for possible restoring after a flame has been lost.

Therefore, due to the high power required, automatic devices with thermocouples, supplied by buffer batteries, have very low autonomy and are therefore not very efficient, often requiring continuous replacement of the batteries by the user.

This represents a limitation to use of such automatic devices in gas apparatuses.

SUMMARY

An embodiment of the present invention provides an automatic device for gas apparatuses, having structural and functional characteristics such as to overcome the limits and/or drawbacks with reference to devices realized according to the prior art.

Another embodiment of the present invention provides an automatic device with low energy consumption in order to dynamically bias the valve means.

An embodiment of the present invention is directed to an automatic device for the ignition and control of a gas apparatus comprising at least one burner for regulating the flow of gas from a main pipe towards a nozzle associated with said at least one burner;

a spark circuit suitable for generating a pilot flame upon receipt a electric start signal;

electrically controlled valve means associated with said at least one burner;—at least one supply voltage provided by the electricity main and/or by battery means, to supply said automatic device an electrical microprocessor unit in said automatic device to drive and to control said valve means and said spark circuit;

at least one actuator circuit activated by said electrical microprocessor unit through an activation signal having a pulse train to dynamically bias said valve means and to regulate its charge state according to the duty cycle of the pulse train.

An advantage of the automatic device according to an embodiment of the invention is that it is substantially a low-voltage device with low power consumption, with electrical and completely independent management in terms of the initial ignition step, in terms of the control of the valve means and for the supervision of the flame. Moreover, such a device, when there are anomalies, allows the completely automatic restoring of the device to be carried out quickly, or else allows it to be made safe.

Another embodiment of the present invention is directed to a method for driving an automatic device for the ignition and control of a gas apparatus equipped with at least one burner and including electrically controlled valve means for regulating the gas flow from a main pipe towards a nozzle associated with said at least one burner;

said automatic device being supplied by at least one supply voltage provided by the electricity main and/or by battery means and being coupled to an ground terminal, said method comprising the following steps:

initial automatic ignition phase activating a spark circuit upon receipt of a start signal to generate a flame in said at least one burner;

driving and controlling said valve means and said spark circuit through an electrical microprocessor unit;

activating at least one actuator circuit coupled to said valve means by means of an activation signal having a pulse train generated by said electrical microprocessor unit;

activating at least one actuator circuit coupled to said valve means by means of an activation signal generated by said electrical unit, said activation signal having a pulse train to dynamically charge said valve means for an activation time period defined by the duty cycle of the pulse train.

An advantage of the method for driving the automatic device according to an embodiment of the invention is its efficiency linked to the low energy consumption required and the completely electrical management in terms of the ignition step, for the flame control step and during the operation of the device; moreover, such a method, when there are anomalies, allows the automatic device to be automatically restored or be made safe quickly.

BRIEF DESCRIPTION OF THE DRAWINGS

Characteristics and advantages of the automatic device according to one or more embodiments of the present invention will be apparent from the following description of an embodiment thereof given by way of indicative and not limiting example with reference to the annexed drawings.

DETAILED DESCRIPTION

With reference to such figures an automatic device made according to an embodiment of the present invention for the ignition and control of a gas apparatus 1 is globally and schematically indicated with 10.

Figure 1:
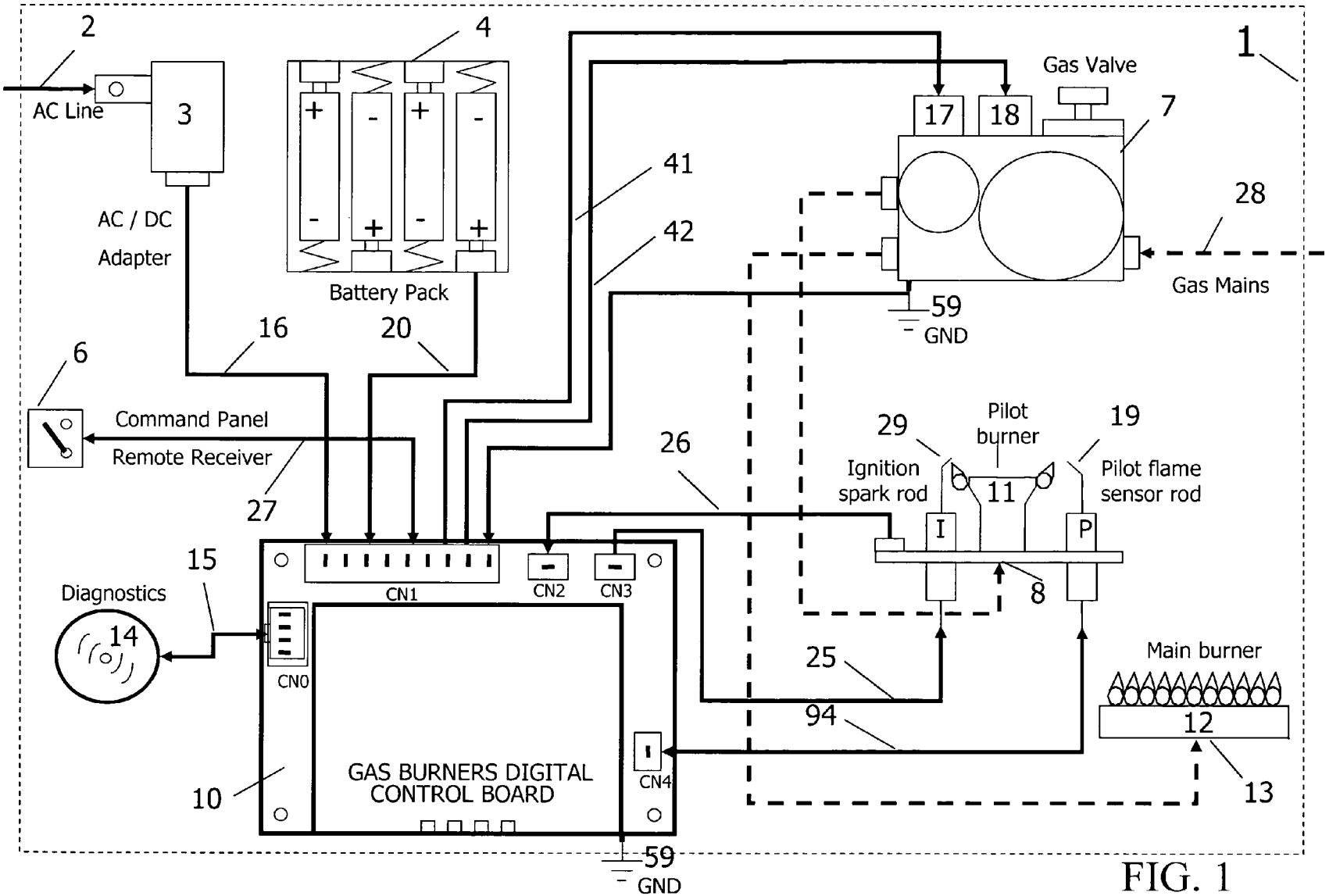
FIG. 1 schematically shows an apparatus of an automatic device for ignition and control, according to an embodiment of the invention.
Figure 2:
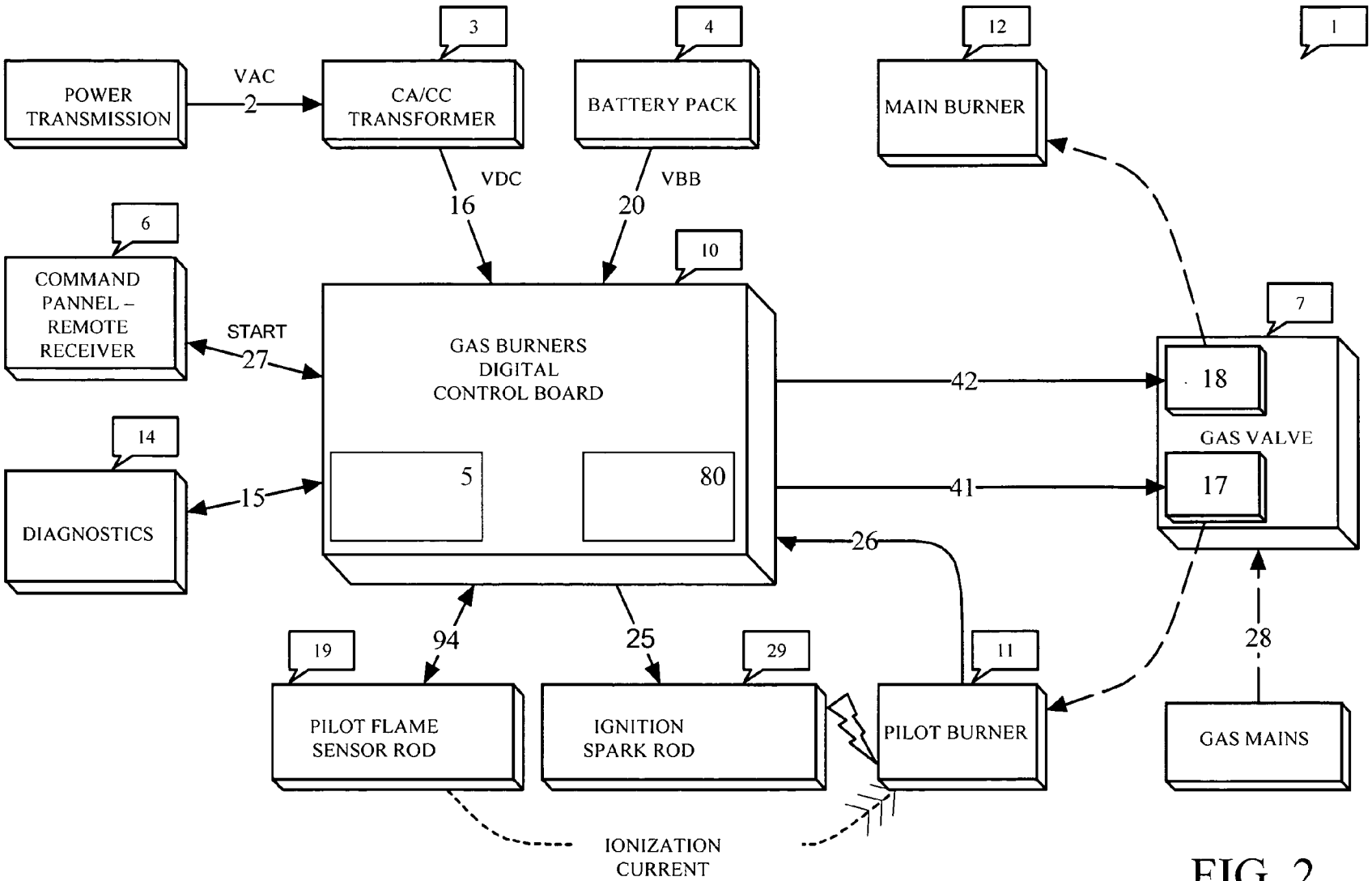
FIG. 2 schematically shows a block diagram of the apparatus of FIG. 1.
Figure 3:
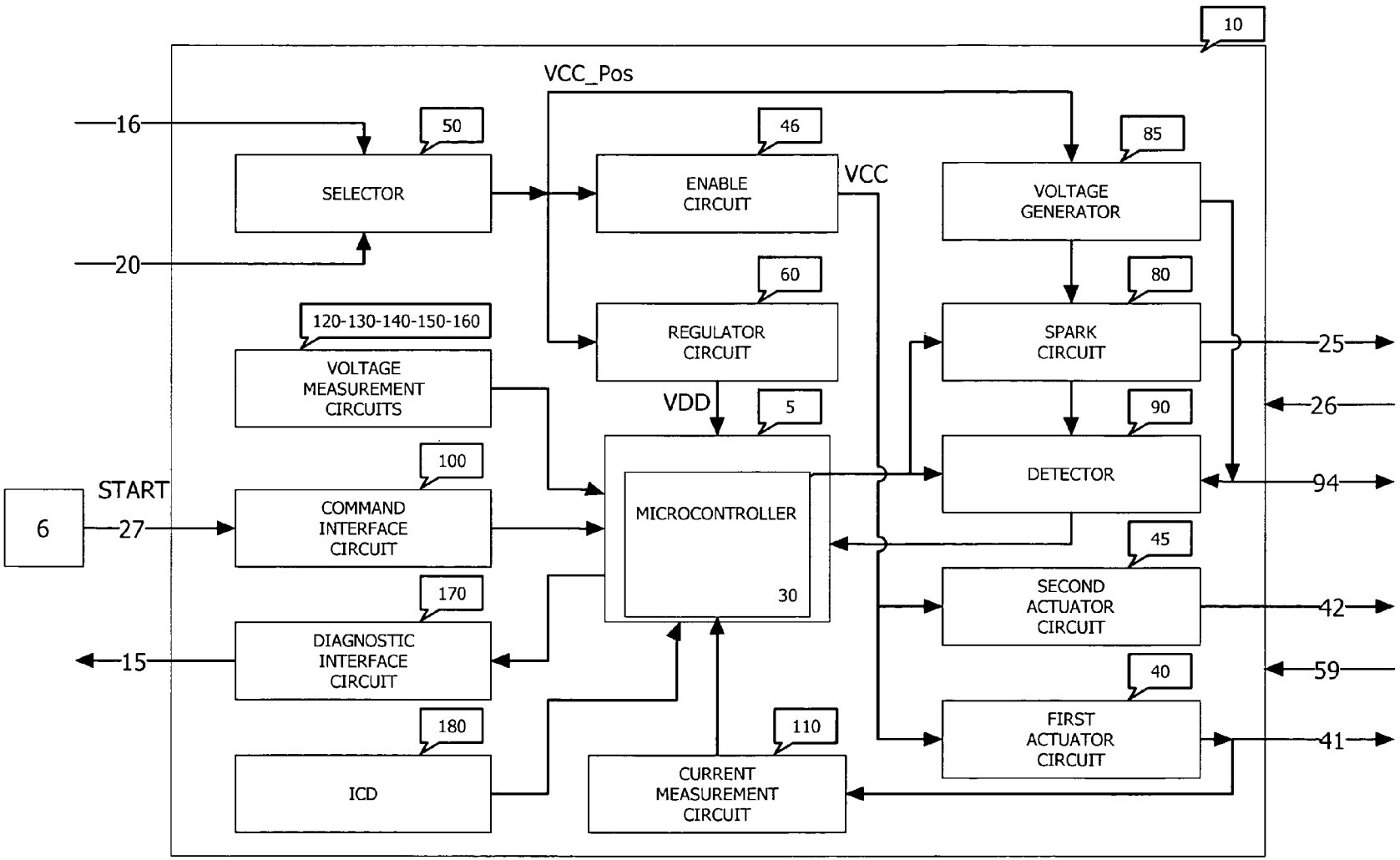
FIG. 3 is a block diagram of the device according to an embodiment of the present invention.

The gas apparatus 1 is in particular a gas fireplace, schematically represented in FIG. 1, but the automatic device 10 can be used in other apparatuses like for example gas stoves and gas braziers and similar.

The gas apparatus 1 is equipped with a pilot burner 11 and with a main burner 12 and suitable electrically controlled valve means 7, for regulating the flow of gas from a main pipe 28 for the gas towards a first nozzle 8, coupled with the pilot burner 11 and to a second nozzle 13, coupled with the main burner 12, respectively.

The pilot burner 11 and the main burner 12 are coupled in the usual way, so that the flame at the pilot burner 11 can act as ignition source for the gas released by the nozzle 13 to the main burner 12. A supply voltage provided by electricity main 2, through a transformer 3, and by battery pack 4 supplies the automatic device 10; the automatic device 10 is coupled through a ground terminal 59 to a constant reference voltage GND that in the present embodiment is a ground voltage.

Moreover, the valve means 7 are supplied by a supply voltage and are of the type with the valve normally closed.

In particular, the valve means 7 comprise a first solenoid 17, which actuates a first shutter associated with the first nozzle 8 so that when the solenoid is crossed by an electric current the first shutter opens allowing the gas to flow, whereas, when the solenoid is not crossed by an electric current the shutter closes blocking the flow of gas.

Similarly, a second solenoid 18 actuates a second shutter associated with the second nozzle 13.

The automatic device 10 comprises a spark circuit 80 suitable for generating a flame on the pilot burner 11, close to the first nozzle 8, upon receipt of a start signal Start.

According to an embodiment of the present invention, the automatic device 10 comprises an electrical microprocessor unit 5 that actuates and electrically controls both the spark circuit 80 and such valve means 7, so as to uniformly and totally burn all of the gas put out exploiting to the highest degree the thermal value as well as in complete safety.

Advantageously, according to an embodiment of the present invention the valve means 7 are activated by the electrical unit 5 and are coupled to the ground terminal 59.

Figure 4:
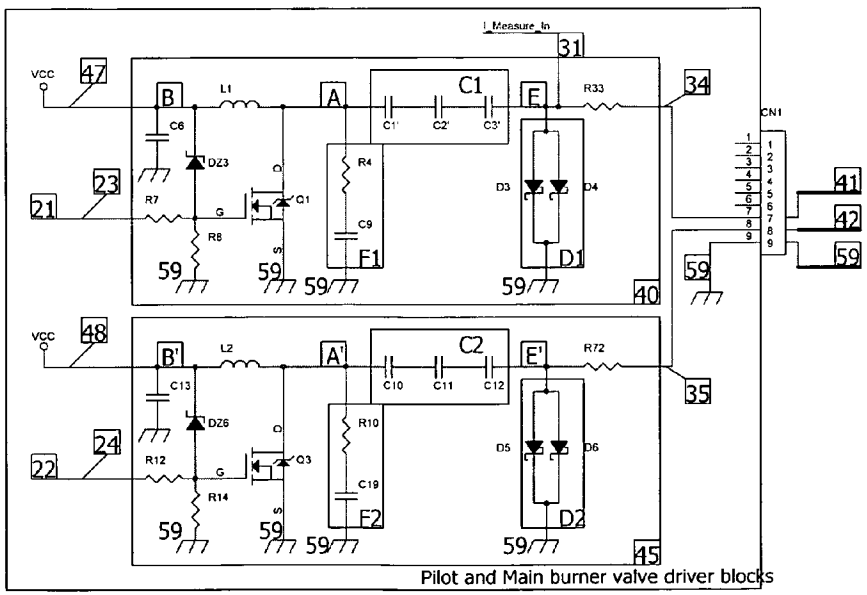

The automatic device 10, as illustrated in FIG. 4, comprises a first actuator circuit 40 and a second actuator circuit 45, structurally similar, dynamically activated by the electrical unit 5, through a first activation signal 21 and a second activation signal 22, respectively.

The first activation signal 21 and the second activation signal 22 are signals having a pulse train with a predetermined charge factor or duty cycle.

Such actuator circuits 40, 45 are suitable for dynamically polarizing the valve means 7 to regulate its charge state according to the duty cycle of the pulse train.

In particular, according to an embodiment of the present invention, the automatic device 10 and in particular the electrical unit 5 is substantially a circuit operating at low voltage that dynamically drives such valve means 7, with a low power consumption and a substantial saving of energy.

The automatic device 10 is supplied by:

the electricity main 2 that supplies a voltage VAC to the transformer rectifier 3, which through a first terminal 16 provides a first supply voltage VDC; and battery pack 4 that supply a second supply voltage VBB through a second terminal 20.

According to an embodiment, the transformer rectifier 3 comprises a Graetz bridge rectifier or else a modern switching voltage regulator, for example of the Step-Down or Buck type.

A remote control panel 6 allows the electrical unit 5 to be activated upon receipt of the start signal Start. The start signal Start is transmitted through a set of terminals 27 and can consist of a protocol, in the form of an encoded signal, or else the reading of a switch or contact open and closed state.

According to an embodiment, the remote control panel 6 comprises a pair of switches coupled to the array of terminals 27.

A diagnostic circuit 14 interacts with the electrical unit 5 through suitable connection terminals 15 and allows the user to keep the automatic device 10 constantly under remote observation, allowing possible anomalies to be diagnosed.

According to an embodiment of the present invention, in the case of anomalies the automatic device 10 acts autonomously intervening to restore its functionality or to place it under safe conditions.

The control panel 6 and the diagnostic circuit 14 could in some cases be incorporated directly in the electrical unit 5.

In particular, the electrical unit 5 comprises a programmable microcontroller 30 capable of storing a management program that analyzes the received signals, generating suitable signals for the operation and for the safety of the automatic device 10 itself.

The automatic device 10 also comprises a selector 50 that is supplied in input by the first supply voltage VDC and by the second supply voltage VBB to supply in output a third constant voltage VCC_Pos, which is substantially the greater of the input supply voltages.

As shall be specified hereafter, the selector 50 uses the battery pack 4 as a buffer battery both in the case of a total lack of the first supply voltage VDC, and in the case in which the electricity main 2 supplies sporadic low voltages compared to a nominal voltage.

In particular, the selector 50 feeds an enable circuit 46, a regulator circuit 60 and a high voltage generator circuit 85.

The enable circuit 46 provides in output a fourth voltage VCC which is a voltage substantially translated in level compared to the third voltage VCC_Pos and suitable for feeding the first 40 and the second actuator circuit 45 and defined arranged control peripherals.

The regulation circuit 60 carries out a first filtering for possible over voltages in the third supply voltage VCC_Pos supplying in output a substantially stabilised fifth supply voltage VDD suitable for feeding the electrical unit 5.

According to an embodiment of the present invention, as highlighted in FIG. 4, the first actuator circuit 40 and the second actuator circuit 45 are supplied by the fourth supply voltage VCC respectively through a first supply terminal 47 and a second supply terminal 48 and they are also coupled to the ground terminal 59. Moreover, they are activated by the first activation signal 21 and by the second activation signal 22 received, respectively, at a first input terminal 23 and at a second input terminal 24.

The first activation signal 21 and the second activation signal 22 having a pulse train have regular pulses of rectangular wave shape with a particular and predetermined charge factor or duty cycle, so as to dynamically activate the valve means 7 coupled to a respective output terminal 34, 35.

In particular, according to an embodiment, the first actuator circuit 40 comprises a first inductance L1, arranged between the first supply terminal 47 and an inner node A, a first capacitance C1, arranged between the inner node A and an output node E, which is coupled with the ground terminal 59 through a first diode D1 that, for greater efficiency, is of the Schottky type.

A first resistance R33 is also arranged between the output node E and the first output terminal 34.

A first switch Q1 is arranged between the inner node A and the ground terminal 59 and is suitably activated at a command terminal G by the first activation signal 21.

The first switch Q1 can be a Fet or Mosfet transistor or else a BJT transistor.

A first resistive divider R7-R8 is coupled with the first input terminal 23 and is coupled to the ground terminal 59 and allows the voltage of the first activation signal 21 to be adjusted in a predetermined way.

Furthermore, the first actuator circuit 40 comprises a first filtering element F1 arranged between the inner node A and the ground terminal 59 capable of filtering the signal present at the inner node A. In particular, the first filtering element F1 comprises, coupled in series, a resistance R4 coupled to the inner node A and to a capacitance C9.

In an embodiment, at the first actuator circuit 40 a Zener diode DZ3 is arranged between the inner node B and the command terminal G of the first switch Q1, to make a further protection of the first actuator circuit 40 against over voltages that could reach the fourth supply voltage VCC through the first supply terminal 47.

The first impulsive activation signal 21, based upon the provided duty cycle, has an activation time period $T_{ON}$ and a deactivation time period $T_{OFF}$ and dynamically biases the first inductance L1 and the first capacitance C1. In particular, the first actuator circuit 40 absorbs electrical energy discontinuously from the fourth supply voltage VCC only during the activation time period $T_{ON}$ and returns it by taking a substantially continuous current from such valve means 7.

The first activation signal 21 generates a potential at the output node E that is kept below the potentials of the other nodes of the first actuator circuit 40. In particular, the potential of the output node E is less than the ground voltage GND of the ground terminal 59.

The activation time period $T_{ON}$ of the first activation signal 21 is substantially less than the deactivation time period $T_{OFF}$.

In other words, unlike the prior art, the first actuator circuit 40:

- during the activation time period $T_{ON}$, receives a charge current, i.e. from the first solenoid 17, keeping the flow of gas to the first burner 11 open;
- during the deactivation time period $T_{OFF}$, the output node E is coupled to the ground terminal 59 through the first diode D1 and thus also the first solenoid 17 and the first solenoid 17 as a effect of its own inductance is crossed by a current still coming out towards the output terminal E, keeping the flow of gas to the first burner 11 open.

This allows, in particular, the energy required by the first actuator circuit 40 during its operation to been substantially reduced with a substantial reduction of the power absorbed.

Figure 19:
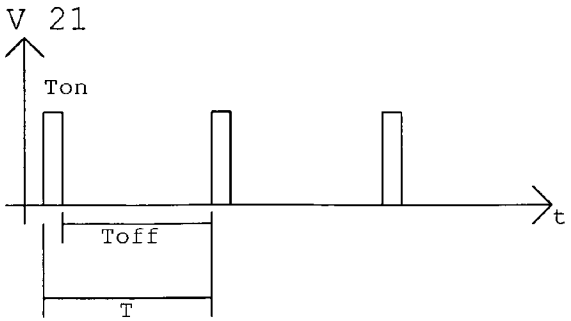
FIG. 19 shows a diagram with a time progression of an activation signal of the actuator circuit according to an embodiment of the present invention.

With reference to FIG. 19, the duty cycle of the first activation signal 21 is defined by the formula:

$$\text{duty cycle}=T_{ON}/(T_{ON}+T_{OFF})$$

where $T_{ON}$ is the activation time period and $T_{OFF}$ is the deactivation time period.

Figure 18:
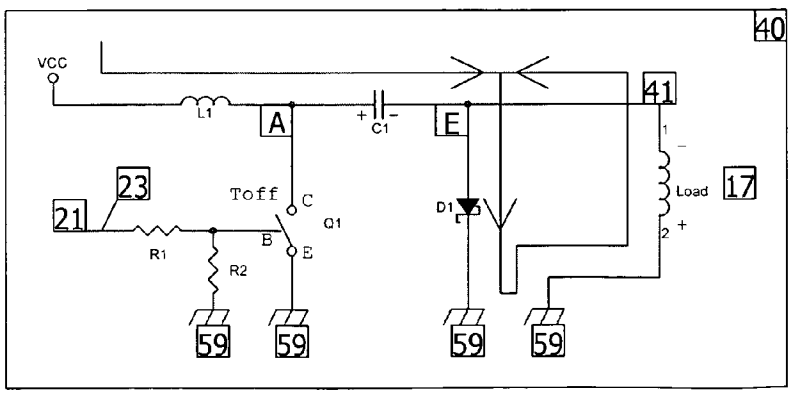
FIGS. 16-18 show an actuator circuit of the valve means, made according to and embodiment of the invention, in the various operating steps.
Figure 16:
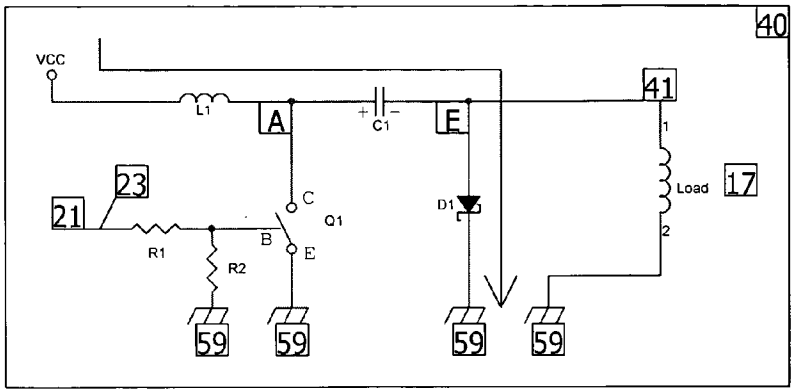
Figure 17:
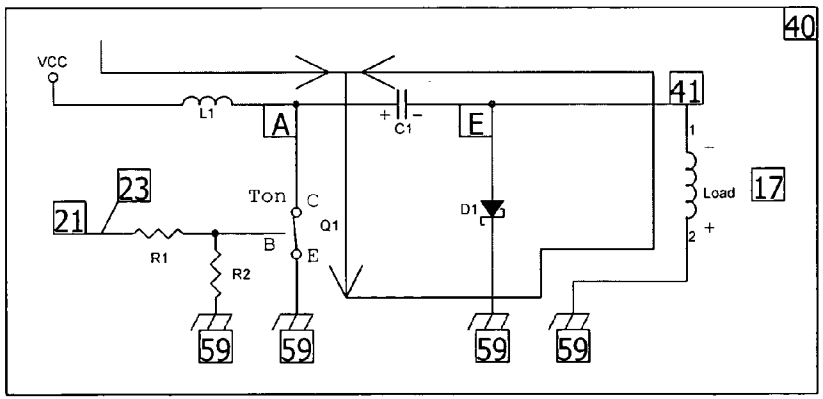

With reference to FIGS. 16-18, the operation of the first actuator circuit 40 is analyzed in particular.

FIG. 16 shows the first actuator circuit 40 in a rest state, in which the fourth supply voltage VCC is present whereas the first activation signal 21 is absent, i.e. the electrical unit 5 enables the enable circuit 46 but still does not command the first actuator circuit 40.

In this case, the first switch Q1 is in open state and the first capacitance C1 is charged at the fourth supply voltage VCC through a current that, from the first supply terminal 47 slips through the first inductance L1, the first capacitance C1 and the first diode D1 towards the ground terminal 59.

FIGS. 17 and 18 illustrate the first actuator circuit 40 activated by the first activation signal 21, in a first and a second operative condition, respectively.

In particular, in the first operative condition, the first activation signal 21 is active for the activation time period $T_{ON}$ and the first switch Q1 closes connecting the inner node A to the ground terminal 59. The first inductance L1 accumulates inductive energy, whereas the first capacitance C1 discharges absorbing current from the first solenoid 17 whilst the first diode D1 is electrically blocked.

In such a first operative condition, for the brief activation time period $T_{ON}$, the first actuator circuit 40 absorbs a current from the first solenoid 17 and in particular a current slips from the charge towards the inner node A making the voltage at the output node E negative with respect to the reference voltage GND present at the ground terminal 59.

In such a first operative condition, the first solenoid 17, crossed by the electric current, allows the first shutter to open allowing the gas to flow to the pilot burner 11, whereas the power required by the first actuator circuit 40 is given by the energy accumulated by the first inductance L1 during the brief activation time period $T_{ON}$.

In the second operative condition, the first switch Q1 is kept open for the passive time period $T_{OFF}$. The first inductance L1 discharges the inductive energy accumulated during the activation time period $T_{ON}$, recharging the first capacitance C1 through the first diode D1 which is also brought into conduction and a current continues to flow from the first solenoid 17 to the first diode D1.

Therefore, also during the deactivation time period $T_{OFF}$, the output node E is kept at a negative voltage with respect to the reference voltage GND of the ground terminal 59. The first solenoid 17, crossed by substantially continuous current, allows the first shutter to be kept open allowing the gas to flow to the pilot burner 11 without any power requirement from the supply and therefore with a substantial saving of energy.

Substantially, therefore, the first actuator circuit 40 activated by the first activation signal 21 keeps the transfer of energy from the to the charge operative with a transfer factor that depends upon the duty cycle of the first activation signal 21.

Furthermore, when the first activation signal 21 is deactivated the first switch Q1 is kept open and the first actuator circuit 40 is taken back into rest state.

Moreover, according to an embodiment of the present invention, the first activation signal 21 has the duty cycle regulated so that the current that crosses the first solenoid 17 for each activation time period $T_{ON}$ and for each deactivation time period $T_{OFF}$, is greater than a minimum opening current suitable for keeping the first shutter open making the gas flow to the pilot burner 11.

According to an embodiment of the present invention, the electrical unit 5 modulates the duty cycle of the first activation signal 21 according to some parameters, like for example:

value of the fifth supply voltage VCC;

value of the minimum opening current of the first solenoid 17;

value of a temperature of the first solenoid 17, as shall become clearer hereafter.

In particular, there is substantially a retroaction between the first actuator circuit 40 and the electrical unit 5. A value of the measured current I_Measure, proportional to the current present at the first output terminal 34, is detected through a detection terminal 31 coupled to the first output node E.

Such a value is suitably processed by the electrical unit 5 based upon suitable reference values stored and possible corrective compensations of the duty cycle of the first activation signal 21 can be foreseen, in relation to the specific parameters of the first solenoid 17, indicated above. This allows a substantial saving of energy at the automatic circuit 10.

Moreover, in the case in which the first solenoid 17 undergoes variations due to the environment temperature that can change the electrical characteristics, for example such as to generate undesired deactivation thereof, the value of the measured current I_Measure undergoes variations which are intercepted by the electrical unit 5 and are compensated correctively by varying the duty cycle of the first activation signal 21.

Similarly, as highlighted in FIG. 4, the second actuator circuit 45 comprises a second inductance L2 arranged between the second supply terminal 48 and an inner node A', a second capacitance C2 arranged between the inner node A' and an output node E' which is coupled with the ground terminal 59 through a second Schottky diode D2. A second resistance R72 is coupled in series between the output node E' and through a second output terminal 35 to the charge or else to the second solenoid 18.

A second switch Q3, arranged between the inner node A' and the ground terminal 59, is driven dynamically by the second activation signal 22 which is suitably regulated in voltage by a second divider R12-R14.

In an embodiment, the second actuator circuit 45 has a Zener diode DZ6 that is arranged between the inner node B' and the command terminal G' of the second switch Q3, to make a further protection against excessive voltages that could reach the fourth supply voltage VCC through the terminal 48.

The second impulsive activation signal 22, based upon the provided duty cycle, regulates a charge time $T_{ON'}$ and a discharging time $T_{OFF'}$ of the second capacitance C2 keeping the second output node E' at a potential that is less than any potential present at the other nodes of the second actuator circuit 45 and in particular of the voltage at the ground terminal 59.

A second filtering element F2 is arranged between the inner node A' and the ground terminal 59 allowing the signal to be filtered at the inner node A' and has, coupled in series, a resistance R12 and a capacitance C19.

Similarly to the first actuator circuit 40, the second actuator circuit 45 biases the second solenoid 18 in relation to the duty signal of the second activation signal 22, providing, in particular, a current to the actuator circuit 40 during the charge time period $T_{ON'}$.

This allows a low energy consumption improving the performance of the automatic device 10 itself.

Furthermore, the first actuator circuit 40 and the second actuator circuit 45 to satisfy defined control and safety regulations can, instead of a first capacitance C1 and a second capacitance C2, have many capacitances C1', C2', C3' and C10, C11 and C12, respectively, arranged in series and placed between the respective inner node A and A' and the output node E and E' as highlighted in FIG. 4.

Similarly, the first actuator circuit 40 and the second actuator circuit 45 to increase efficiency of energy conversion can, as an alternative to the first diode D1 and the second diode D2, have two or more diodes, D3 and D4, as well as D5 and D6, respectively, arranged in parallel and coupled between the output node E, E' and the ground terminal 59. Such diodes can, in some cases, be Schottky diodes.

It is worth noting that the first resistance R33 and the second resistance R72, in series respectively with the output nodes E, E', could be replaced by a pair of inductances of a value similar to the first and second inductance L1 and L2, without for this reason jeopardizing the operation of the actuator circuits 40 and 45, as well as of the automatic device 10. Therefore, it is possible to improve the attenuation of possible interferences conducted from and towards the nodes E, E' at the first drive signal 41 and at the second drive signal 42, also allowing current specific regulations to be respected, like for example the regulations known by the acronym EMC (Electro-Magnetic Compatibility).

Furthermore, the diode DZ3 and the diode DZ6 may not be present without for this reason jeopardizing the operation of the actuator circuits 40 and 45, as well as of the automatic device 10.

Moreover, according an embodiment there is retroaction between the first actuator circuit 40 and the electrical unit 5. According to this embodiment, the automatic device 10 comprises an unique connector CN1, shown repeatedly in FIGS. 4, 6 and 13, which represents a unitary and main connection interface between the electrical unit 5 and the peripherals of the automatic device 10, allowing quick and easy connection.

In particular, the connector CN1 receives the first supply voltage VDC through the first terminal 16 and the second supply voltage VBB through the second terminal 20, and it is suitably coupled to the ground terminal 59.

Figure 13:
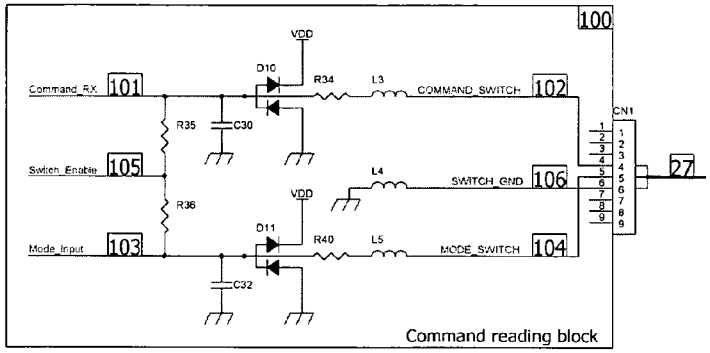

In particular, the connector CN1 has three successive terminals that contact a command reading circuit 100, shown in FIG. 13, which receives respective signals 101, 103 coming through the set of terminals 27 from the command panel 6. Such signals 101, 103 are interpreted by the microcontroller 30 so as to generate the activation signal for the enable circuit 46 for driving the first actuator circuit 40 and the second actuator circuit 45.

Finally, the connector CN1 has three further terminals that contact the valve means 7 respectively coupling the output terminals 34, 35 and the ground reference terminal 59 of the first 40 and of the second actuator circuit 45, to respective terminals 41 and 42 of the first solenoid 17 and of the second solenoid 18.

Even more specifically, a fourth input terminal of the connector CN1 is arranged to receive a switching signal Command_Switch, a fifth input terminal of the connector CN1 is arranged to receive a selection signal Mode_switch and a sixth terminal of the connector CN1 is arranged to receive the return signal Switch_GND provided by the connection with the set of terminals 27 towards a command panel 6.

Figure 6:
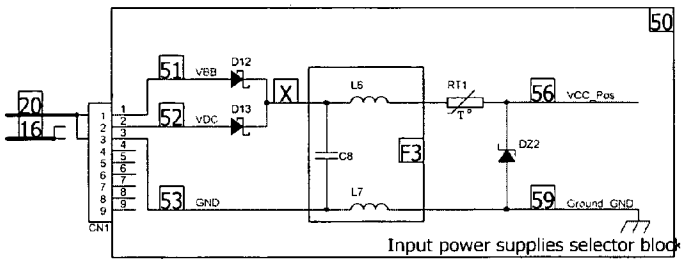

The selector 50, illustrated in FIG. 6, receives, in particular through the connector CN1, the first supply voltage VDC and the second supply voltage VBB respectively at a second input terminal 51 and at a first input terminal 52, and it is coupled to the ground terminal 59 to supply, to an output terminal, the third supply voltage VCC_Pos. In particular, the third supply voltage VCC_Pos is the maximum voltage between the input supply voltages. According to an embodiment, the selector 50 comprises a first diode D12, in series with the first input terminal 51, and a second diode D13, in series with the second input terminal 52, as well as a filter F3 suitably coupled in series with the first diode D12 and with the second diode D13 and coupled to the output terminal 56.

Advantageously, the first diode D12 and the second diode D13 are of the Schottky type and in particular go into blocking mode in the presence of possible inverse voltages at the respective input terminals, blocking the passage of current.

The first filter F3 comprises a first capacitance C8, a first inductance L6 and a second inductance L7 and attenuates possible interferences conducted, from and towards the first input terminal 51 and the second input terminal 52, in particular respecting current specific regulations, like for example the regulations known by the acronym EMC (Electro-Magnetic Compatibility).

A fuse RT1 and a third diode DZ2, Zener type, are coupled to the output terminal 56 and make a protection from possible over voltages and over currents. Indeed, when there are over voltages the third diode DZ2 goes into inverse conduction, whereas the fuse RT1 is activated once a so-called marker current has been exceeded.

It is worth noting that the first inductance L6 and the second inductance L7 of the filter F3 could be replaced by a pair of short-circuits, without for this reason jeopardising the operation of the selector 50, as well as of the automatic device 10.

In the most general form, the selector 50 operates in the presence of the first supply voltage VDC and the second supply voltage VBB and the battery pack 4 take care of possible supply voltage drops of the electricity main 2, as a buffer battery.

In particular, during operation, the first diode D12 and the second diode D13 automatically impose upon an inner node X of the selector 50 a voltage that in value is the greater from the first supply voltage VDC and the second supply voltage VBB. A possible temporary or extended drop in the first supply voltage VDC makes just the first diode D12 conduct automatically connecting the battery pack 4 and offering a low direct voltage drop at the output terminal 56.

Therefore, the first diode D12 and the second diode D13 allow a non-conflicting connection between the first supply voltage VDC and the second supply voltage VBB avoiding the first supply voltage VDC from overloading the battery pack 4 damaging them and at the same time avoiding the battery pack 4 being needlessly consumed.

According to a possible embodiment, such battery pack 4 provide a voltage of 6V, with four 1.5V batteries arranged in series, whereas the voltage in output from the transformer provides a nominal voltage equal to 7V.

In further embodiments, the second supply voltage VBB has a field of variation of between 4V and 6.4 V according to the level of charge of the battery pack, whereas the first supply voltage VDC has a field of variation of between 4V and 8.5 V.

Figure 5:
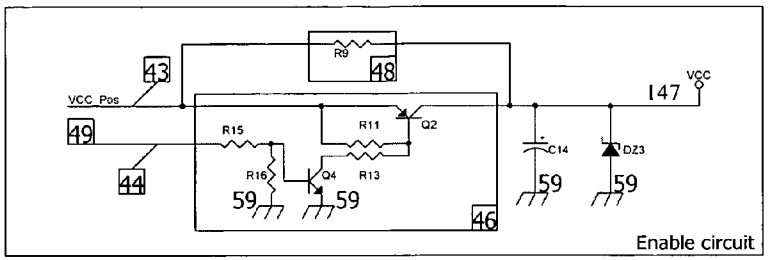
FIGS. 4-15 show details of the blocks as shown in FIG. 3.

The enable circuit 46, illustrated in FIG. 5, is supplied at a supply terminal 43 by the third supply voltage VCC_Pos and is enabled at an input terminal 44 by an enabling signal 49, provided by the microcontroller 30, to generate the fourth supply voltage VCC at an output terminal 147.

In particular, the enable circuit 46 comprises a first transistor Q2 coupled between the supply terminal 43 and the output terminal 147 with a command terminal coupled to the input terminal 44 through the interposition of a second transistor Q4, which is suitably coupled to the ground terminal 59 and has a command terminal coupled to the input terminal 44.

Preferably, the first transistor Q2 is of the bipolar PNP type and is coupled to a common emitter through the interposition of a first resistance R11.

Moreover, a first resistive divider R15-R16 allows the voltage of the enabling signal to be regulated at the command terminal of the second transistor Q4, whereas a second resistance R13 arranged between the second transistor Q4 and the first transistor Q2 allows the bias voltage at the latter to be regulated.

A buffer capacitance C14 is coupled in parallel between the output terminal 147 and the ground terminal 59, allowing the voltage at the output terminal 147 to be stabilized.

It is worth noting that the enabling circuit 46 is substantially a safety circuit made to satisfy defined current regulations. Alternatively, a replacement resistance R9 could be arranged between the input terminal 43 and the output terminal 147 of the enable circuit 46, supplying the fourth supply voltage VCC directly and permanently to the first actuator circuit 40 and to the second actuator circuit 45.

Figure 7:
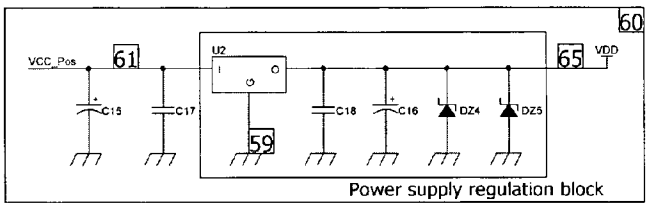

According to the present embodiment, the regulation circuit 60, shown in FIG. 7, at an input terminal 61 receives the third supply voltage VCC_Pos and supplies the fifth supply voltage VDD, which is substantially a stabilised voltage suitable for feeding the electrical unit 5, to an output terminal 65.

The regulation circuit 60 is also coupled to the ground terminal 59.

An integrated linear regulator U2 is arranged between the input terminal 61 and the output terminal 65, a first capacitance C15 and a second capacitance C17 are coupled in parallel arranged between the input terminal 61 and the ground terminal 59, whereas a third capacitance C18, a fourth capacitance C16 and a pair of Zener diodes DZ4 and DZ5 are coupled in parallel between the output terminal 65 and the ground terminal 59.

Figure 8:
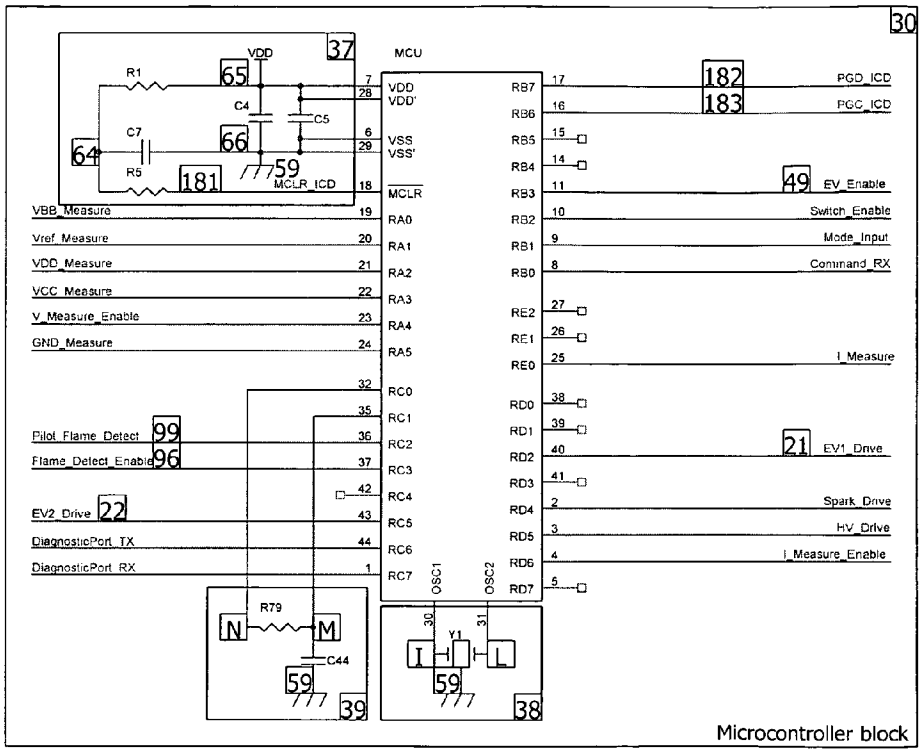

In the present embodiment, the electrical unit 5 comprises, as shown in FIG. 8, a stabilization network 37 associated with the microcontroller 30, which comprises passive components able to stabilise the operation.

In particular, the stabilisation network 37, supplied at a first node 65 by the fifth supply voltage VDD, has a second node 66 coupled to the ground terminal 59, a first capacitance C4 and a second capacitance C5 coupled in parallel with each other between the first node 65 and the second node 66, with the ends coupled to respective supply pins VDD and VSS, VDD' and VSS' of the microcontroller 30.

In particular, the first capacitance C4 and the second capacitance C5 absorb possible variations in current that can be generated by sources either inside or outside the electrical unit 5 due to quick switching of electrical currents and voltages.

Moreover, a delayed circuit comprising a first resistance R1 and a third capacitance C7 arranged in series between the first node 65 and the second node 66, as well as a second resistance R5 coupled between a third node 64 and a pin MCLR_ICD of the microcontroller 30, allows the fifth supply voltage VDD to be stabilized ensuring that the microcontroller 30 starts up with a voltage that is as stable as possible.

A first clock reference circuit 38 coupled with two terminals I and L, to two different pins OSC1 and OSC2 of the microcontroller 30 and coupled to the ground terminal 59 that comprises a ceramic resonator Y1.

The ceramic resonator Y1, in particular, allows an onboard timer installed in the microcontroller 30 to be oscillated at an appropriate frequency allowing a correct operation of a logic part installed in the microcontroller 30 and allowing the microcontroller 30 to carry out timed functions.

According to the present embodiment, a second reference circuit 39 is present in the electrical unit 5 and comprises a timer used as independent source for checking the operation of the first clock reference circuit 38 and vice-versa.

Figure 20:
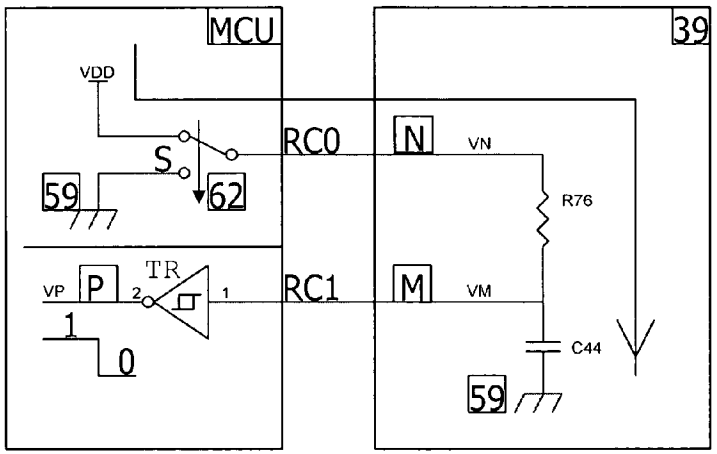
FIGS. 20-21 show a time reference circuit associated with an electrical unit and made according to an embodiment of the invention, in two operating steps.
Figure 21:
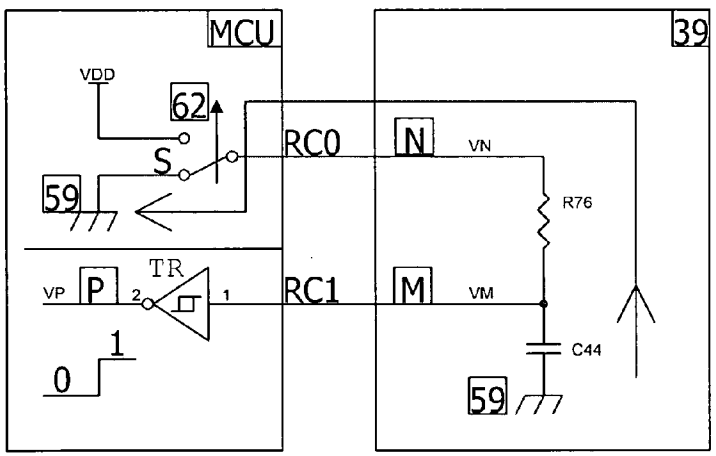

In particular, the second reference circuit 39, as illustrated in FIGS. 20 and 21, comprises a switch S arranged between the fifth supply voltage VDD and the ground terminal 59 activated by a command signal 62 coming from the microcontroller 30. The switch S suitably drives an Schmitt trigger inverter TR, coupled in cascade, which has a lower threshold voltage $V_{ML}$ and an upper threshold voltage $V_{MH}$.

A suitable resistance R76 is arranged between an output terminal RC0 of the switch S and an input terminal RC1 of the inverter TR whereas a capacitance C44 is coupled between the input terminal RC1 and the ground terminal 59.

Figure 22:
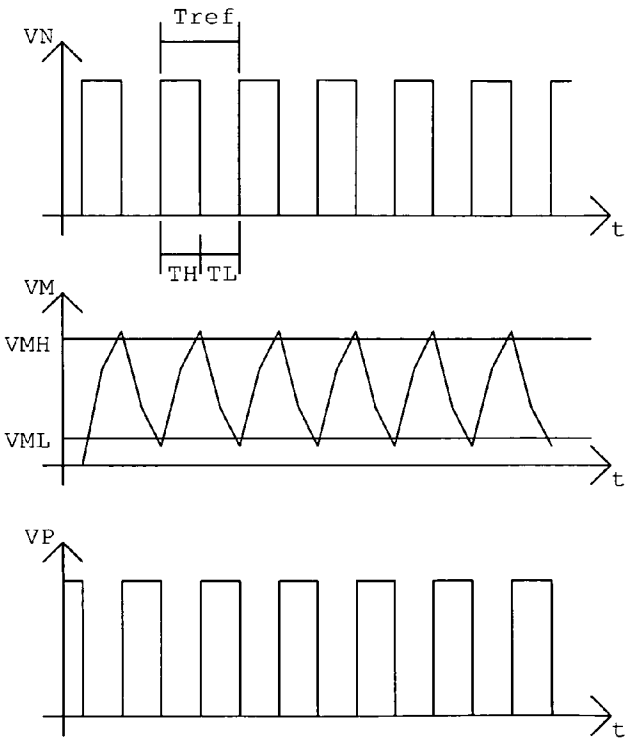
FIG. 22 shows a diagram with time sequences of operating signal relative to the circuit of FIG. 20.

In particular, when the command signal 62 of the switch S switches in relation to a third signal $V_P$ present at the output terminal P of the inverter TR, a first signal $V_N$ at the output terminal RC0 switches. Based upon the value of the resistance R76 and of the capacitance C44, a second signal $V_M$ with exponential ramp is generated at the input terminal RC1. The second signal $V_M$ drives the inverter TR and the third signal $V_P$ has a waveform substantially analogous to that of the first signal $V_N$ but suitably shifted in time. The time sequences of the first signal $V_N$, of the second signal $V_M$ and of the third signal $V_P$ are shown in FIG. 22.

The first signal $V_N$ has a duty cycle substantially independent from the inner peripherals of the microcontroller 30, in particular it has a period $T_{ref}$ equal to:

$$T_{ref}=T_H+T_L$$

Where $T_H$ is the time with presence of high logic level signal $T_L$ is the time in the absence of the signal The period $T_{ref}$ is compared by the microcontroller 30 with a period of the clock generated by the ceramic resonator Y1 to satisfy defined control and safety regulations.

A comparison between the magnitudes provided by the first ceramic resonator Y1 and by the first reference circuit 38 as well as a suitable management of the signals of the second reference circuit 39 allows the microcontroller 30 to recognize possible deviations between the magnitudes provided, placing if necessary the electrical unit 5 in a stop state and the electronic device 10 in a safety state.

The switch S and the inverter TR can be integrated directly into the microcontroller 30 and, in this case, the output terminal RC0 and the input terminal RC1 are pins of the microcontroller 30.

The microcontroller 30, as shown in FIG. 8, has a plurality of further input pins RA0, RA1, RA2, RA3, RA5, RE0 coupled to a plurality of control peripherals suitable for providing analogue signals, as well as further pins provided to receive digital signals or rather signals with a significant interpretation only based upon two levels of discrete voltages, of the "high" or "low" or "0" or "1" type and that shall be described hereafter.

Figure 9:
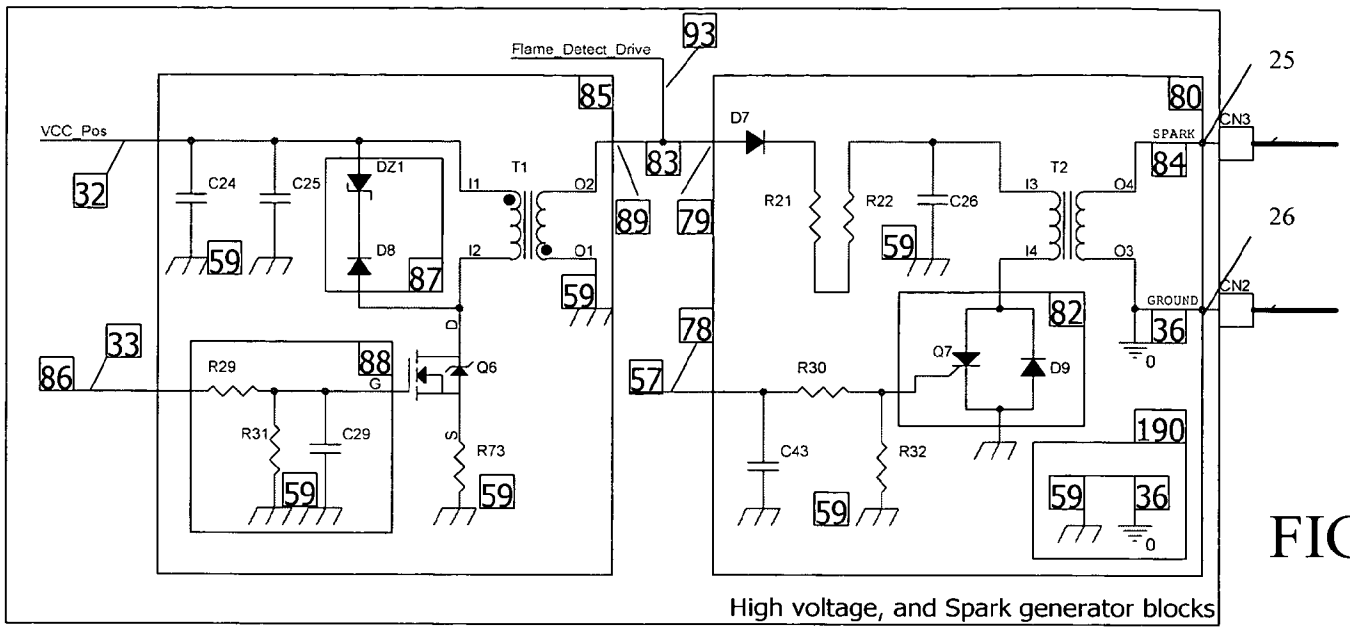

According to the present embodiment, the voltage generator 85, shown in FIG. 9, is supplied at a supply terminal 32 by the third supply voltage VCC_Pos and is activated by a first command signal 86 received at an enabling terminal 33 to supply a high voltage impulsive bias signal 83 to an output terminal 89.

The first command signal 86 is generated by the microcontroller 30 and is of the impulsive type regulated according to the fourth supply voltage VCC, suitably measured by said microcontroller 30 through a fifth voltage measurer 160, which is described hereafter.

In particular, the voltage generator 85 comprises a first transformer T1 with a primary winding the terminals I1-I2 of which are respectively coupled to the supply terminal 32 and to a switch Q6 which is suitably coupled to the ground terminal 59 and is activated by the first command signal 86.

The first transformer T1 has a secondary winding the terminals O1-O2 of which are respectively coupled with the output terminal 89 and with the ground terminal 59.

According to an embodiment, the first transformer T1 has a transformation ratio equal to 10.

A filtered divider element 88 is arranged between the first enabling terminal 33 and the switch Q6 to process the first command signal 86 and dynamically actuate the switch Q6.

The filtered divider element 88 is an R-C network and has a first resistance R29 as well as a second resistance R31 and a first capacitance C29, coupled in parallel with each other, arranged between the enabling circuit 33 and the ground terminal 59.

Moreover, a second capacitance C24 and a third capacitance C25, for filtering, coupled in parallel to each other, and arranged between the input terminal 32 and the ground terminal 59 allow possible interferences present in the third supply voltage VCC_Pos to be filtered.

Furthermore, a first diode DZ1, Zener type, and a second diode D8 are coupled in parallel to the primary winding I1-I2 of the first transformer T1.

Finally, a resistance R73 is arranged between the ground terminal 59 and a conducting terminal of the switch Q6 to limit the maximum reachable value by the conducting current of the switch Q6.

The bias signal 83 generated at the output terminal 89 is a high voltage alternating pulse train signal suitable for actuating the flame detector 90 as well as for feeding the spark circuit 80.

The spark circuit 80 receives the bias signal 83 at an input terminal 79 coupled to the output terminal 89 of the voltage generator 85, and is activated by the microcontroller 30 through a second command signal 57, suitably having a pulse train, received at a second enabling terminal 78.

The spark circuit 80, between a first output terminal 25 and a second output terminal 26 provides a suitable discharge signal 84 with a high voltage difference, that is sufficient to generate sparks or electrical discharges, to generate the pilot flame, in a suitable first electrode 29 at the first nozzle 8 of the pilot burner 11.

According to the present embodiment, the second output terminal 26 is coupled to a further ground terminal 36.

In particular, the spark circuit 80 comprises a second transformer T2 with a primary winding the terminals I3-I4 of which are coupled between the input terminal 79 and the ground terminal 59 and a secondary winding with the terminals O3-O4 coupled to the first output terminal 25 and to the second output terminal 26.

According to an embodiment, the first output terminal 25 is coupled to a third connector CN3 and the second output terminal 26 is coupled to a second connector CN2.

Moreover, the spark circuit 80 comprises a third diode D7 a first resistance R21 and a second resistance R22, in series, coupled between the input terminal 79 and the primary winding I3-I4 of the second transformer T2, whereas a first capacitance C26 is coupled between the second transformer T2 and the ground terminal 59.

A triggering element 82 is arranged between the second transformer T2 and the ground terminal 59 and comprises a thyristor Q7 of the SCR triggering type and a fourth diode D9, arranged in antiparallel with each other.

The thyristor Q7 is activated by the second command signal 57 suitably regulated in voltage by a filtered divider R30-R32-C43 coupled between the enabling terminal 78 and the ground terminal 59.

As regards the operation of the voltage generator 85 as well as of the spark circuit 80, the first impulsive command signal 86 with a predetermined duty cycle, dynamically activates the switch Q6 between a closed operative condition, i.e. coupled to the reference voltage GND, and an open operative condition for a predetermined number of switches per second.

When the switch Q6 is in the closed operative condition an electric current crosses the primary winding I1-I2 of the first transformer T1 and a suitable energy is accumulated, a portion of such energy transfers to the secondary winding O1-O2, generating a negative semi-wave of the bias signal 83.

When the switch Q6 is in the open operative condition, a mesh is suitably formed between the primary winding I1-I2 of the first transformer T1, the first diode DZ1 and the second diode D8. In particular, a current crosses the first diode DZ1, which is taken into inverse conduction, and the second diode D8, which is taken into direct conduction.

In such an open operative condition, the remaining portion of the energy accumulated by the first transformer T1 transferred to the secondary winding O1-O2 generates the remaining positive semi-wave of the bias signal 83. This semi-wave charges the fourth capacitance C26 of the spark circuit 80 through the third diode D7, the resistance R21 and the resistance R22.

After the defined number of switches of the first command signal 86, the fourth capacitance C26 of the spark circuit 80 suitably charges to a predetermined high voltage value.

When the thyristor Q7 goes into conduction, activated by the second command signal 57, a mesh is formed between the primary winding I3-I4 of the second transformer T2 and the fourth capacitance C26.

At the same time, the second transformer T2, with a high transformation ratio, generates the discharge signal 84 at the secondary winding O3-O4 with a high voltage and in particular able to overcome the dielectric rigidity of air, producing sparks, at the first electrode 29 arranged near to the first nozzle 8 of the pilot burner 11, of sufficient energy to ignite the gas and generate the pilot flame.

The output terminal 25 is advantageously connected to a discharge terminal associated with the first electrode 29 through the second connector CN2 and the third connector CN3, both of the type suitable for high voltages.

A suitable conductive return mesh of the discharge current is formed through the pilot burner 11, the first nozzle 8 and the discharge terminal connected to the second connector CN2, as well as through the further ground terminal 36 and the output terminal O3 of the secondary of the second transformer T2.

According to an embodiment, the fourth capacitance C26 is charged to a voltage of about 120-140V and through the second transformer T2 causes a spark having a voltage of about 15-30 kV near the first electrode 29.

The spark circuit 80, in some embodiments, could be integrated in the electrical unit 5.

A connection block 190, represented in FIG. 9, is arranged between the ground terminal 59 and the further ground terminal 36 to make a star network and thus ensure the electrical continuity in the automatic device 10 minimising the propagation of the interferences generated by the discharge signal 84, respecting defined current regulations, in particular EMC (Electro-Magnetic Compatibility).

For functional purposes, the connection block 190 can be replaced by a resistance of sufficiently high value respecting current regulations.

Figure 10:
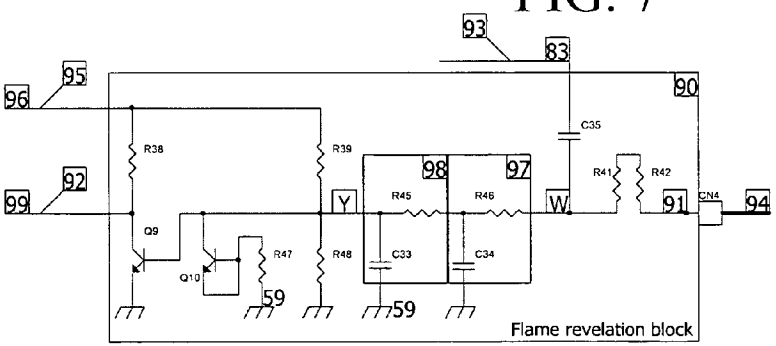

The detector 90, illustrated in FIG. 10, is supplied by the bias signal 83 received at an input terminal 93 and allows it to be checked whether there is a pilot flame in the pilot burner 11, exploiting an ionization detection principle. In particular, through such an ionization detection principle, the detector 90 detects the presence of a flame by analyzinq a current received at a control terminal 91 which is coupled to a second ionization electrode 19 introduced in the pilot flame and suitable biased through the bias signal 83.

The detector 90, suitably sized, has sensitivity and a rate of response that satisfy the current regulations.

The detector 90, connected to the ground terminal 59, receives the flame detection signal 94 at the control terminal 91. Moreover, the detector 90 comprises an activation terminal 95 that receives an activation signal 96, generated by the microcontroller 30, and an output terminal 92 that provides a verification signal 99 having a pulse train.

The verification signal 99 is suitably analyzed by the microcontroller 30 within a predetermined time period.

As known to the skilled in the art, the ionization detection principle makes it possible to check for the presence of a flame surrounding two electrodes subject to a potential difference. In such a condition, the two electrodes are, indeed, crossed by a weak electric current whereas, by inverting the polarity of the voltage in the presence of a flame between the two electrodes, the current becomes substantially zero.

The behaviour of two electrodes introduced in the flame can be simulated with a circuit comprising a rectifying diode with high direct resistance.

In particular, in the present embodiment, the first nozzle 8 being metallic and being coupled to the further ground terminal 36 defines the second electrode. Therefore, in the presence of a flame, when the ionization electrode 19 has a positive voltage with respect to the first nozzle 8 there is a passage of current and the flame is recognized as lit. On the other hand, when by inverting the polarity of the voltage, the voltage difference between the ionization electrode 19 and the first nozzle 8 is negative there is no passage of current even if the flame is lit.

Furthermore, in the absence of a flame, when the electrode 19 has a positive or negative voltage with respect to the first nozzle 8, there is no passage of current since the mixture of air and fire-proof gas is an electrical insulator at the voltage values used.

The detector 90 comprises a first capacitance C35 arranged between the input terminal 93 and a first inner node W, a first resistance R41 and a second resistance R42, in series, coupled between the first inner node W and the control terminal 91.

Moreover, the detector 90 comprises a first filtering element 97 and a second filtering element 98, consisting of R-C circuits, coupled together in series and arranged between the first inner node W and a second inner node Y.

The first filtering element 97 comprises a third resistance R46 coupled to the first inner node W and coupled to a second capacitance C34 in turn connected to the ground terminal 59. Similarly, the second filtering element 98 comprises a fourth resistance R45 coupled to a third capacitance C33 in turn connected to the ground terminal 59.

A divider comprising a fifth resistance R39 and a sixth resistance R48, arranged between the activation terminal 95 and the ground terminal 59, allows the rest voltage of the inner node Y to be suitably regulated from the level of the activation signal 96.

Furthermore, a first bipolar transistor Q9 arranged between the output terminal 92 and the ground terminal 59 is commanded by a signal coming from the second inner node Y.

Finally, a seventh resistance R38 is arranged between the activation terminal 95 and the output terminal 92.

The detector 90 can have a protection and compensation network for the temperature variation that comprises a second transistor Q10, suitably diode-connected, arranged between the second inner node Y and the ground terminal 59 through an eighth resistance R47 of high resistive value.

As regards the operation of the detector 90, a current that averages out at zero detected by the detection signal 94 keeps the average value of the alternating voltage present at the first inner node W practically unchanged, also keeping the second inner node Y at a continuous voltage level upper than a conduction voltage of the first transistor Q9.

Therefore, the first transistor Q9 is kept in a conduction area and provides the output terminal 92 with a voltage that the microcontroller 30 interprets as low logic level, i.e. "0" or absence of flame.

On the other hand, a current of positive average value detected by the detection signal 94 lowers the average value of the alternating voltage present at the first inner node W, also lowering the continuous voltage present at the second inner node Y. In this way, the first transistor Q9 comes out from the conduction area zeroing the current through the seventh resistance R38 that is no longer crossed by current and the voltage at the output terminal 92 increases. The microcontroller 30 interprets such a voltage as high logic level, i.e. "1" detecting a presence of flame.

Advantageously, the verification signal 99 is of the type with rectangular wave and is generated by the detection signal 94 which is suitably alternated and generated by the bias signal 83 having a pulse train.

Moreover, thanks to the fact that the verification signal 99 is analyzed through the microcontroller 30 in a predetermined time period, it is possible to distinguish a real presence of a flame from an anomalous or parasite conductive pathway that could give false flame detection.

Indeed, possible conductive pathways created in the presence of carbon residues deposited due to poor combustion or else in the presence of foreign bodies in the pilot burner 11, or even in the presence of aesthetic embers of mineral substance that are often scattered in the combustion chamber, can easily be detected by the microcontroller 30.

Moreover, it is worth noting that since the bias signal 83 alternates with a succession of pulse trains, equipped with a suitably defined duration and frequency, as well as a peak voltage of around one hundred volts, it allows the voltage generator circuit 85 to ensure a transfer to the detector 90 of a peak current of the detection signal 94 with a value around the unit of microamperes, adequate for normal requirements.

Figure 23:
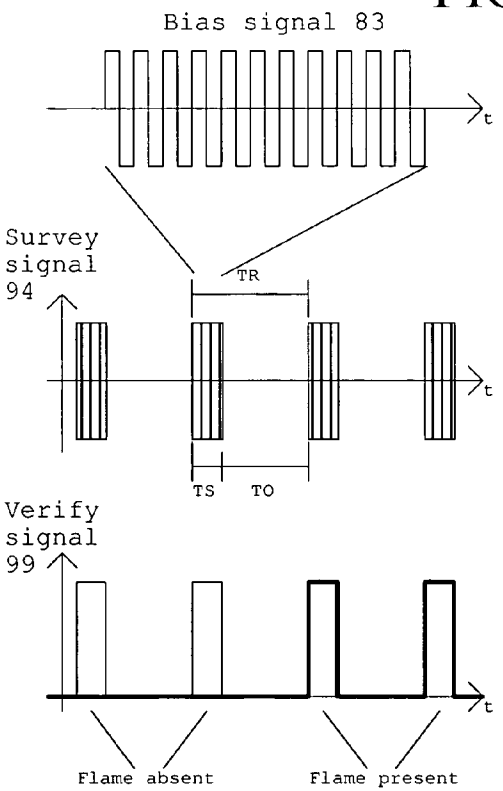
FIG. 23 illustrates a diagram with time progressions of operating signal relative to a flame detector made according to an embodiment of the present invention.

The time sequences of the bias signal 83, of the detection signal 94 and of the verification signal 99 are schematically shown in FIG. 23.

In particular, the detection signal 94 has a first active time period $T_S$ and a second passive time period $T_O$ that are defined by the bias signal 83.

Even more particular, the electrical unit 5 through the first command signal 86 activates in pulses the voltage generator 85, which generates the high voltage alternating bias signal 83 at the output terminal 89 for the first time period $T_S$ that is transferred as detection signal 94 and biases the second ionization electrode 19. At the same time, the microcontroller 30, through the activation signal 96, activates the detector 90 and measures the verification signal 99 for the same first time period $T_S$.

After such a predetermined time window $T_S$, the electrical unit 5 deactivates the first command signal 86 and the voltage generator 85 stops providing the bias signal 83 that cancels out like the detection signal 94 and stops biasing the second ionization electrode 19.

Simultaneously, even if the detector 90 shows for the second time period $T_O$ the (desired) loss of detection signal 94, the microcontroller 30 suspends the acquisition of the verification signal 99.

Advantageously, the second time period $T_O$ is greater than the first time period $T_S$.

The measurement of the presence of flame is detected through the electrical unit 5 only during the first active time period $T_S$. Advantageously such a time period $T_S$ is reduced to fractions of the order of a tenth of a second that substantially is the period in which the pulse train of the bias signal 83 is kept active at the voltage generator 85. A substantial saving in energy is thus obtained.

Indeed, during the second time period $T_O$, the bias signal 83 is deactivated with a substantial saving of energy especially in the case in which the electronic device 10 is supplied exclusively by the battery pack 4.

The bias signal 83 has a time sequence of alternating voltage pulse trains that has frequency and duty cycle equal to:

$$\text{Frequency detection } f_R=1/T_R=1/(T_S+T_O)$$

$$\text{Duty cycle detection } d_R=T_S/(T_S+T_O)$$

Which advantageously allows the consumption to be kept low whilst still ensuring a real and immediate recognition following the real loss of flame with a maximum reaction time of less than the one second that fully satisfies the regulations of the regulations.

Figure 11:
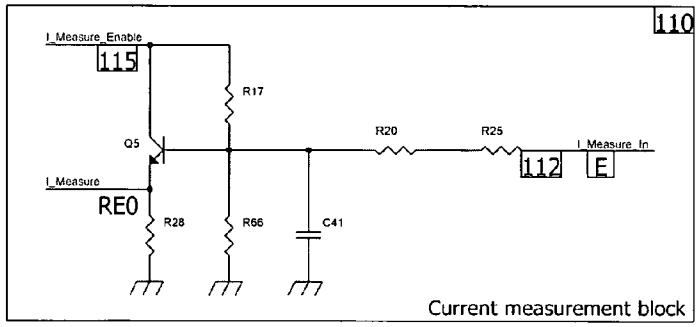

A control peripheral of the automatic device 10 is a current measurer 110, illustrated in FIG. 11, which when activated by the microcontroller 30, through an enabling signal 115, at a first input terminal 112, coupled to the detection terminal 31 of the first actuator circuit 40, detects a signal proportional to the current present at the first output terminal 34. The current measurer 110 provides such a measured current value I_Measure to an output terminal RE0 coupled to the microcontroller 30 to carry out some checks.

In particular, the current measurer 110 comprises an amplifier with common collector, coupled to suitable resistive and capacitive elements, which is enabled by the enabling signal 115.

Figure 12:
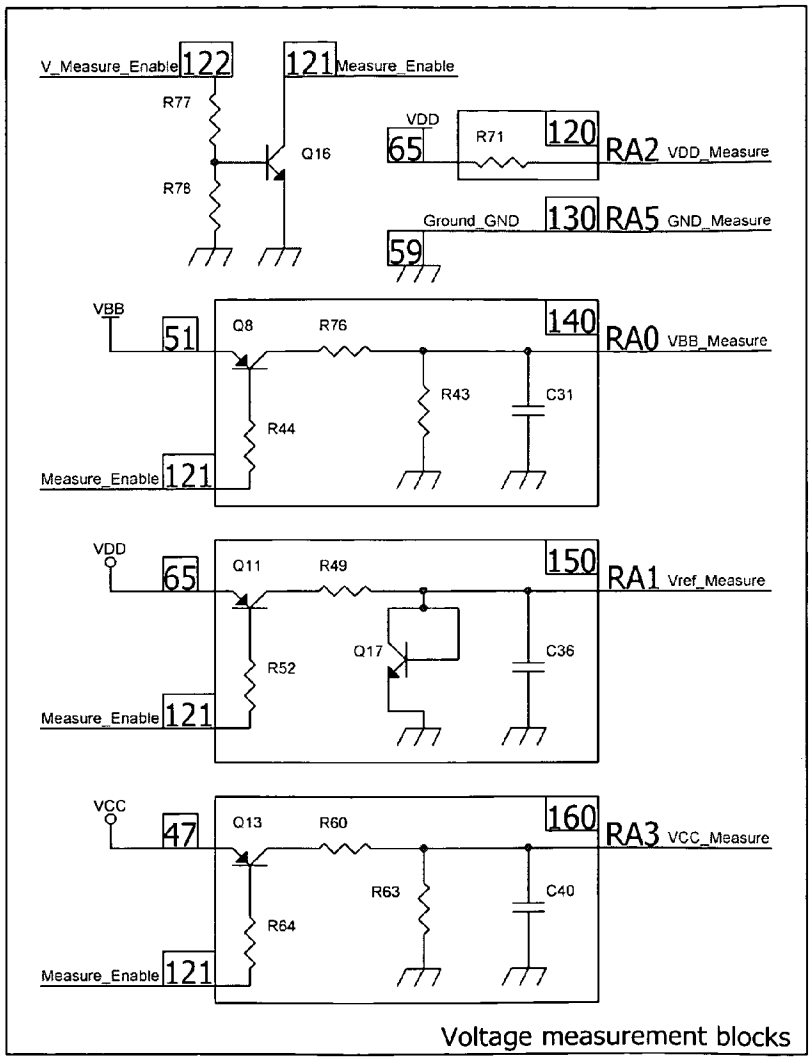

The automatic device 10 comprises further voltage measurers, illustrated in FIG. 12, activated by a single enabling signal 122, generated by the same microcontroller 30, and suitable for providing the microcontroller 30 with a measurement of the voltages present in the automatic device 10 for specific checks and necessary comparisons and regulation.

In particular, a first voltage measurer 120 measures the fifth supply voltage VDD present at the output terminal 65 of the detection circuit 60, using a resistance R71 and providing such a measurement to a first analogue input RA2 of the microcontroller 30.

A second voltage measurer 130 implicitly measures the reference voltage GND of the ground terminal 59 and provides it to a second analogue input RA5 of the microcontroller 30.

A third voltage measurer 140 measures the supply voltage VBB supplied by the battery pack 4 and through a network of substantially R-C passive elements generates a measured supply voltage VBB_Measure that is supplied to a third analogue input RA0 of the microcontroller 30.

A fourth voltage measurer 150 takes the fifth supply voltage VDD and, through a network of substantially R-C passive elements and a bipolar transistor coupled with diode, generates a reference voltage Vref_measure that is supplied to a fourth analogue input RA1 of the microcontroller 30.

In particular, the measured reference voltage Vref_measure is acquired at an input independent both from the fifth supply voltage VDD measured through the first voltage measurer 120, and from the reference voltage GND detected through the second voltage measurer 130. Therefore, the microcontroller 30 uses the three distinct magnitudes that are compared with each other in the safety checks for self-diagnosis and in the satisfaction of the regulations of the regulations.

Finally, a fifth voltage measurer 160 detects the fourth supply voltage VCC and through a network of substantially R-C passive elements generates a voltage VCC_Measure that is supplied to a fifth analogue input RA3 of the microcontroller 30.

In particular, it is worth highlighting that through a suitable activation of the transistor Q16 by the microcontroller 30 all of the measuring blocks 140, 150 and 160, shown in FIG. 12, are able to be deactivated/activated simultaneously.

More in particular, the deactivation of such measuring blocks saves a few hundred microamperes of supply current.

Further suitable blocks and peripherals can be coupled or present in the automatic device 10 to satisfy specific requirements.

Figure 14:
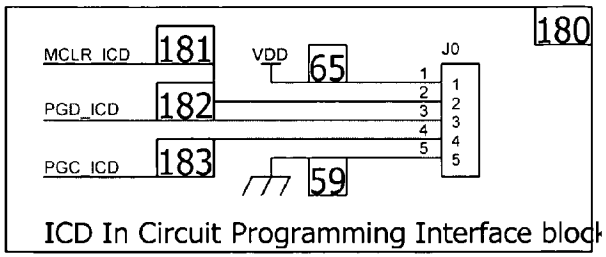

A suitable interface block 180, shown in FIG. 14, comprises a fifth connector $J_O$, connected to the fifth supply voltage VDD and to the ground terminal 59 as well as to the microcontroller 30 through three command terminals 181, 182, 183 and allows rapid connection to the microcontroller 30 for rapid programming.

Figure 15:
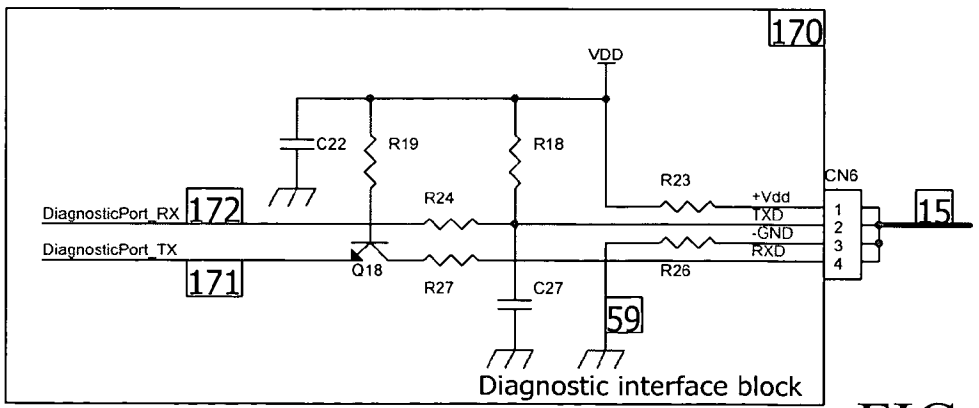

Finally, the automatic device 10 comprises a diagnostic block 170, shown in FIG. 15, which is supplied by the fifth supply voltage VDD and is coupled to the ground terminal 59 as well as receives a first diagnostic signal 172 and a second diagnostic signal 171 from the microcontroller 30 suitable for providing the diagnostic circuit 14 with four interface signals +Vdd, TXD, −GND, RXD, through a sixth connector CN6.

The diagnostic circuit 14 can comprise an acoustic element for emitting encoded sounds, or else it can consist of a luminous device for emitting encoded flashes or it can be a serial communication interface for exchanging data through a suitable protocol.

As regards the operation of the automatic device 10, according to the present embodiment, for ignition of the automatic device 10 the electrical unit 5 from the command circuit 6 receives the start signal Start, which can be generated by an external command signal, or received from a user, or from means for detecting the room temperature.

In the ignition step, the electrical unit 5 commands the voltage generator 85 in pulses through the first command signal 86, which, at the output terminal 89, generates the high voltage alternating bias signal 83 suitable for commanding the spark circuit 80 and for driving the detector 90 both enabled by the microcontroller 30.

The detector 90 detects the detection signal 94 from the second ionization electrode 19 close to the pilot burner 11 and through the flame detection principle provides the microcontroller 30 with the verification signal 99, detecting an initial absence of flame.

Once it has been verified that there is no flame, otherwise a breakdown symptom, since the commands to open the gas are still inactive, the electrical unit 5 enables the enable circuit 46 with activation of the enabling signal 49 and the actuator circuit 40 with the activation of the first activation signal 21.

Simultaneously, the electrical unit 5 with the second command signal 57 activates the spark circuit 80, which generates the discharge signal 84 through the formation of an electrical discharge repeated over time at the corresponding output terminals 25 and 26 to make a series of sparks in a suitable first electrode 29 at the first nozzle 8 to generate the pilot flame in the pilot burner 11.

Simultaneously, the first actuator circuit 40 suitably biases the first solenoid 17 in relation to the duty cycle of the first activation signal 21, regulating the passage of the gas through the pilot burner 11.

The ignition sequence of the pilot flame is completed when the verification signal 99 generated by the detector 90 and analyzed by the microcontroller 30 in the predetermined time window detects a continuous flame that hits the second ionization electrode.

In this case, it is deactivated the second command signal 57 at the spark circuit 80 and the discharges at the first electrode 29 are stopped. The detector 90 continues to check the pilot flame in the pilot burner 11 thanks to the second ionization electrode 19 and the electrical unit 5 is ready for the ignition of a flame in the main burner 12, if required, with the activation of the second activation signal 22 and the corresponding bias of the second solenoid 18.

Simultaneously, the microcontroller 30 through the peripherals checks the correct operation of the automatic device 10.

In the case of anomalies, the microcontroller 30 activates the diagnostic interface block 170 that provides respective signals that can be processed by the diagnostic circuit 14, coupled to the electrical unit 5, which according to the requirements and the design specifications, allows suitable and specific alarm signals to in turn be generated.

An embodiment of the present invention also refers to a method for driving an automatic device for the ignition and control of a gas apparatus, of the type described previously for which details and cooperating parts having the same structure and function shall be indicated with the same reference numbers and symbols.

A method according to an embodiment of the present invention refers to an automatic device 10 of a gas apparatus 1 which is equipped with a pilot burner 11 and a main burner 12, coupled in the usual way. Moreover, suitable electrically controlled valve means 7 allow the flow of gas to be regulated from a main pipe 28 towards a first nozzle 8, associated with the pilot burner 11, and to a second nozzle 13, associated with the main burner 12.

Such a driving method is basically based upon the dynamic actuator of a first actuator circuit 40 and of a second actuator circuit 45 through, respectively, a first activation signal 21 and a second activation signal 22 having a pulse train, generated by an electrical unit 5 with a microcontroller. The pulses of such activation signals 21, 22 have a predetermined duty cycle $$\text{duty cycle}=T_{ON}/(T_{ON}+T_{OFF})$$

where: $T_{ON}$ is the activation time period $T_{OFF}$ is the deactivation time period.

The valve means 7 are dynamically polarized by such actuator circuits 40, 45 regulating the charge state according to the duty cycle of the pulse train of such activation signals 21, 22, allowing a substantial saving of energy.

The actuator circuits 40, 45 are made so that, during the actuator of the respective activation signal 21, 22, the voltage at a respective output node E, E' is less than the voltages of any inner node, and in particular less than the voltage of the ground terminal 59.

Substantially, according to an embodiment of the present method the actuator circuits 40, 45 are structurally and functionally similar.

Preferably, a first inductance L1 and a first capacitance C1, arranged in series between a first supply terminal 47, which receives a fourth supply voltage VCC, and the output node E associated with a first output terminal 34, as well as a first diode D1 arranged between the output node E and an ground terminal 59, are used to make the first actuator circuit 40.

A first switch Q1, coupled between an intermediate inner node A and the ground terminal 59, is suitably dynamically commanded by the electrical unit 5 through the first activation signal 21 having a pulse train. The intermediate node A is arranged between the first inductance L1 and the first capacitance C1.

The valve means 7 and in particular a first solenoid 17 is connected to the first output terminal 34, the first solenoid 17 also being connected to the ground terminal 59.

In particular, in order to suitably actuate the first actuator circuit 40, the method provides a preliminary step supplying the fourth supply voltage VCC and keeping the first switch Q1 open.

Thereafter, the method provides actuating the first actuator circuit 40 through the first activation signal 21 having a pulse train, to dynamically polarize the valve means 7 and in particular the first solenoid 17.

For the dynamic bias of the first solenoid 17, during the activation time period $T_{ON}$ the first capacitance C1 is advantageously connected to the ground terminal 59 through the first switch Q1. Therefore, the first actuator circuit 40 absorbs current from the first solenoid 17 making the voltage at the output node E negative.

Consequently, during the deactivation time period $T_{OFF}$, the output node E is connected to the ground terminal 59 through the first diode D1 which is taken into conduction and also absorbs a recirculation current coming from the first solenoid 17.

The activation time period $T_{ON}$ is foreseen to be substantially shorter than the deactivation time period $T_{OFF}$.

Therefore, the first actuator circuit 40 provides a power transfer from the power supply, fourth supply voltage VCC, to the valve means 7 that is defined based upon the value of the duty cycle of the pulse train. In particular, there is an absorption of energy just during the activation time period $T_{ON}$ of the first activation signal 21.

The method provides modulating the duty cycle of the first activation signal 21 according to some parameters, like for example:

value of the fourth supply voltage VCC;

value of the minimum current relative to an active condition of the first solenoid 17 to open the corresponding shutter;

temperature value of the first solenoid 17.

Preferably, according to an embodiment of the present invention, a method provides at least one feedback measuring step which provides taking a measured current value I_Measure, proportional to the current value present at the first output terminal 34, through a detection terminal 31. The detection terminal 31 is connected near to the first output node E and suitably connected to the electrical unit 5.

The method thus provides analyzing the measured current value I_Measure through the electrical unit 5, comparing it with suitable reference values stored in the microcontroller and modulating the duty cycle of the first activation signal 21, providing possible corrective compensations.

Similarly, to suitably actuate the second actuator circuit 45, the method provides a preliminary step supplying the fourth supply voltage VCC and keeping a second switch Q2 open.

Thereafter, the method provides actuating the second actuator circuit 45 providing the activation signal 22 having a pulse train to dynamically polarize the valve means 7 and in particular a second solenoid 18.

The fourth supply voltage VCC is generated by an enable circuit 46 arranged in series with a selector 50 which is supplied by a first supply voltage VDC, supplied by a rectifying transformer 3 coupled in series and supplied by the network voltage VAC of the electricity main 2, as well as by a second supply voltage VBB supplied by battery pack 4.

A method provides equipping the selector 50 with a first diode 12 and with a second diode 13, suitably arranged in series with the input terminals to supply an inner node X with the third continuous supply voltage VCC_Pos allowing a non-conflicting connection between the first supply voltage VDC and the second supply voltage VBB to avoid the first supply voltage VDC from overloading the battery pack 4 damaging them and consequently preventing the battery pack 4 from being needlessly consumed.

In particular, a method according to an embodiment of the present invention provides the steps of:

initial automatic ignition, activating an spark circuit 80 suitable for generating a pilot flame at the first nozzle 8 of the pilot burner 11 when a start signal Start is received, through the electrical unit 5.

More in particular, according to an embodiment of the present invention, the initial automatic ignition step provides the following preliminary steps:

receiving and interpreting the start signal Start by the electrical unit 5 according to a specific and provided protocol, the start signal Start being emitted by a remote control panel 6;

activating a voltage generator 85 and activating a flame detector 90 and verifying an initial condition of pilot flame not present;

activating the voltage generator 85 to generate a spark through a discharge signal 84 near to the first nozzle 8.

A method provides:

activating the voltage generator 85 through a first command signal 86 with pulse train and with a predetermined duty cycle, generated by the electrical unit 5, to generate the bias signal 83, advantageously with alternating pulse train and having a high voltage, at the output terminal;

activating the spark circuit 80 through a second command signal 57, also with pulse train with a predetermined duty cycle, generated by the electrical unit 5, to generate the high voltage discharge signal 84 at the output terminal. The discharge signal 84, compared to the voltage present at the ground terminal 59, has a voltage difference suitable for generating suitable sparks at the first nozzle 8.

According to an embodiment of the present invention, the electrical unit 5 according to a measured supply voltage VCC_Measure through a fifth voltage measurer 160 regulates the first command signal 86. Moreover, a method provides:

activating the detector 90 with a suitably timed activation signal 95 generated by the electrical unit 5 to control the pilot flame in the pilot burner 11.

The method provides detecting the flame at the first burner 11, through the ionization principle, receiving a detection signal 94 of a flame coming from a second ionization electrode 19 at a control terminal 91 and then providing a verification signal 99 to the electrical unit 5.

The method then provides the step of analyzing the verification signal 99 in a predetermined time period through the electrical unit 5.

According to an embodiment of the present invention, the flame detection signal 94 is an alternating signal with a negative voltage part and a positive voltage part to allow a real presence of flame to be distinguished from a parasite conductive pathway.

Once the pilot flame at the first nozzle 8 of the burner 11 has been generated and controlled, the method provides using the pilot flame as ignition source for a main flame near to the second nozzle 13 of the main burner 12.

A method according to an embodiment of the present invention provides suitably actuating the second actuator circuit 45, through the activation by the electrical unit 5 of the second activation signal 22 with pulse train to dynamically bias the valve means and in particular the second solenoid 18 and regulate the gas flow from the main pipe 28 to the main burner 12. A second inductance L2 and a second capacitance C2, in series between a second supply terminal 48 and a second output terminal 35, as well as a second diode D2, arranged between the output terminal 35 and the ground terminal 59, and a second switch Q2 suitably dynamically commanded by the electrical unit 5 through the second activation signal 22 having a pulse train, are used to make the second actuator circuit 45.

In an analogous way to what generally occurs, the method then provides the steps of:

constantly checking the pilot flame in the pilot burner 11 through the detector 90 and the electrical unit 5.

The method provides further steps of detection of the voltages and of the currents present in the automatic device 10, through special blocks;

such steps are suitably timed by the electrical unit 5 with a microcontroller in a logic suitable for instantaneously detecting possible anomalies of the automatic device 10 as well as for minimising the energy consumption of the automatic device 10.

Such steps, for example, provide the use of a first current measurer 110, as well as of a first 120, a second 130, a third 140, a fourth 150 and a fifth 160 voltage measurer, these being enabled simultaneously by the same enabling signal 122 provided by the electrical unit 5.

Further detection blocks can be present to satisfy specific regulatory or requirements or specific and detailed needs.

An advantage of an automatic device according to an embodiment of the invention is its low energy consumption as well as its automatic management in terms of the flame ignition command, in terms of the flame control, and in terms of the safe restoring of the device in the presence of anomalies. Indeed, the actuator circuits, dynamically activated through the pulse train by the electrical unit with a microprocessor, bias the valve means with an energy transfer from the power supply just in the activation time period defined by the duty cycle of the pulse train of the respective activation signals.

A further advantage is given by the fact that thanks to the feedback between the first actuator circuit and the electrical unit it is possible to regulate the duty cycle of the pulse train of the activation signals activating the first actuator circuit and biasing the valve means with less use of energy.

Another advantage is given by the energy saving due to the timed actuation between the voltage generator, the spark circuit and the detector and by the fact that the detection of a flame through the verification signal is timed.

Such advantages, in particular, allow extremely low energy consumption with a substantial and unusual saving of energy, in this way allowing the automatic device to be suitably supplied with just the battery means for a significant period of time.

A further advantage of an automatic device according to an embodiment of the present invention is the versatility of use; indeed, the spark circuit can be commanded remotely for flame ignition and completely automatic control of the entire device.

Another advantage of the automatic device is given by the safety provided; indeed, the detector allows automatic quick checking of the flame leaving the electrical unit to safely manage the entire automatic device and in particular the valve means. A further advantage of the automatic device is given by the speed of response to possible anomalies of the pilot flame and to the capability to distinguish a real flame from another conductive pathway. In particular, the possible loss of the pilot flame is detected by the electrical unit 5 allowing resetting for safe management of the automatic device. Indeed, the detector uses the ionization flame detection principle and uses the alternating voltage pulse train detection signal.

Another advantage of the automatic device is given by the opportunity to activate the gas apparatus in complete safety through remote command, with a remote control or with a radio control.

Another advantage is the versatility of the present electronic device. Thanks to the fact that the valve means are biased through the actuator circuit activated by the activation signal with pulse train with duty cycle that can be regulated by the electrical unit, the automatic device can be adapted to a wider range of valve means equipped with substantially inductive solenoids with low supply voltage. In particular, the automatic device can replace other devices in existing apparatuses.

Another advantage of a pilot method according to an embodiment of the present invention is its efficiency linked to the low energy consumption required and to the completely electronic management in terms of the command to the spark circuit, in terms of the flame control and in terms of the control of the operation of the automatic device.

Moreover, such a method allows the device to be completely automatical and to be quickly restored or made safe.

From the foregoing it will be appreciated that, although specific embodiments of the invention have been described herein for purposes of illustration, various modifications may be made without deviating from the spirit and scope of the invention.

What is claimed:

1. Automatic device for the ignition and control of a gas apparatus comprising:

at least one burner for regulating the flow of gas from a main pipe towards a nozzle associated with said at least one burners;

a spark circuit suitable for generating a pilot flame upon receipt an electric start signal;

electrically controlled valve means associated to said at least one burner;

at least one supply voltage provided by the electricity main and/or by battery means to supply said automatic device;

an electrical microprocessor unit in said automatic device to drive and to control said valve means and said spark circuit;

at least one actuator circuit supplied by the supply voltage and activated by said electrical microprocessor unit through an activation signal at an output node having a pulse train to dynamically bias said valve means and to regulate said valve means charge state according to the duty cycle of the pulse train; said actuator circuit having the potential at the output node below a reference voltage during an ON-time period of the activation signal in order to receive a charge current from the valve means;

wherein said activation signal generates a potential at the output node of the actuator circuit that is kept below the potentials of the other nodes of said actuator circuit;

wherein the at least one actuator circuit has a detection terminal for measuring a current value proportional to the current value present at one output terminal of the actuator circuit in order to regulate by a feedback the duty cycle of the pulse train of the activation signal; and wherein said at least one actuator circuit comprises:

an inductance arranged between a supply terminal receiving a fourth supply voltage and an inner node;

a capacitance arranged between said inner node and the output node, said output node being connected through an output terminal to said valve means;

a first diode arranged between said output node and a ground terminal; and a switch arranged between said inner node and said ground terminal activated by said activation signal suitable for dynamically charging and discharging said inductance and said capacitance generating a potential at the output node that is lower than a reference voltage of said ground terminal.

2. Automatic device according to claim 1, wherein said duty cycle of said activation signal is in relation to said supply voltage.

3. Automatic device according to claim 1, wherein said duty cycle of said activation signal is in relation to a minimum current suitable for activating said valve means.

4. Automatic device according to claim 1, wherein said activation signal has a regular pulse train.

5. Automatic device according to claim 1, wherein it comprises a first actuator circuit suitable for biasing a first shutter associated with a first solenoid of said valve means, coupled with a pilot burner, and in that it comprises a second actuator circuit suitable for polarizing a second shutter associated with a second solenoid coupled to a main burner.

6. Automatic device according to claim 5, wherein the spark circuit is supplied by a bias signal having a pulse train generated by a voltage generator, the voltage generator and the spark circuit being commanded by the electrical unit through a first command signal and a second command signal respectively, both having a pulse train.

7. Automatic device according to claim 6, wherein the bias signal has alternating high voltage pulses.

8. Automatic device according to claim 7, wherein the first command signal is regulated according to said supply voltage measured by said electrical unit.

9. Automatic device according to claim 8, wherein the voltage generator comprises:

a first transformer which is arranged between an input terminal and an output terminal of the voltage generator, and connected through a third switch to the ground terminal;

said third switch being commanded by the first command signal for driving the first transformer and for generating said bias signal at the output terminal.

10. Automatic device according to claim 9, wherein said spark circuit comprises:

a second transformer arranged between an input terminal and an output terminal of the spark circuit, and by means of a trigger element at the ground terminal, the second transformer receiving the bias signal by the input terminal;

a rectifying diode arranged between the input terminal and said second transformer, a capacitance arranged between the second transformer and said ground terminal;

the trigger element being commanded by the second command signal for driving the second transformer and for generating a discharge signal at the output terminal, the discharge signal having a voltage overcomes to the air dielectric rigidity and suitable for generating a pilot flame.

11. Automatic device according to claim 10, wherein further comprises a detector supplied by the bias signal and activated by an activation signal generated by said electrical unit, said detector generating a detection signal of the pilot flame by means of an ionization detection principle.

12. Automatic device according to claim 11, wherein the detector comprises an input terminal that receives the bias signal, a first capacitance arranged between . the input terminal and a first inner node, the first inner node being connected to a first control terminal receiving a detection signal of the pilot flame, the detector comprising an activation terminal that receives the activation signal for generating at an output terminal the detection signal having a pulse train.

13. Automatic device according to claim 12, wherein the electrical unit analyzes the impulsive detection signal of the detector in a predetermined time window, for determining a presence of flame.

14. Automatic device according to claim 5, wherein the first actuator circuit and said second actuator circuit have multiple capacities respectively coupled in series with each other and arranged between the inner node and the output node and multiple diodes coupled in parallel to each other and arranged between the output node and the ground terminal.

15. Method for driving an automatic device for the ignition and control of a gas apparatus comprising at least one burner including electrically controlled valve means for regulating the flow of gas from a main pipe towards a nozzle associated with said at least one burner; said automatic device being supplied by at least one supply voltage provided by the electricity main and/or by battery means, said method comprising the following steps:

initial automatic ignition phase activating a spark circuit upon receipt of a start signal to generate a flame in said at least one burner;

driving and controlling said valve means and said spark circuit by means of an electrical microprocessor unit;

activating at least one actuator circuit coupled to said valve means by means of an activation signal generated by said electrical unit, said activation signal having a pulse train with a voltage potential below a reference voltage to dynamically charge said valve means for an activation time period defined by the duty cycle of the pulse train wherein charge current is received from the valve means;

wherein an inductance is placed between a supply terminal of said actuator circuit and an inner node, a capacitance is arranged between said inner node and an output node, connecting said output node with an output terminal to said valve means and arranging a switch between said inner node and the ground terminal commanded by said activation signal suitable for dynamically biasing said inductance and said capacitance to generate a voltage at said output node that is lower than the potentials of the other nodes of said actuator circuit.

16. Method according to claim 15, wherein said duty cycle of said activation signal is related to said supply voltage.

17. Method according to claim 15, wherein said duty cycle of said activation signal is related to a minimum current suitable for actuating said valve means.

18. Method according to claim 15, wherein said activation signal is foreseen with regular pulse train.

19. Method according to claim 15, wherein the voltage of said output node is lower than a reference voltage of said ground terminal.

20. Method according to claim 19, wherein it comprises the step of:

initial automatic ignition phase activated upon receiving a start signal emitted by a control panel to said electrical unit, said initial automatic ignition step providing the preliminary following steps of:

receiving and interpreting said start signal by said electrical unit;

activating a voltage generator by means of a first command signal, said first command signal having a pulse train with a predetermined duty cycle, to generate a bias signal with alternating high voltage pulse train at an output terminal;

supplying a detector through said bias signal and activating said detector through an activation signal, to generate a detection signal at a control terminal suitable for controlling the pilot flame and subsequently checking an initial condition of pilot flame absents in a first nozzle of said pilot burner.

21. Method according to claim 20, further comprising the steps of:

supplying an spark circuit through said bias signal, activating said spark circuit through a second command signal having a pulse train with a predetermined duty cycle, to generate a discharge signal suitable for generating, at an output terminal, a pilot flame at said first nozzle;

dynamically driving a first actuator circuit through a first activation signal to generate the first drive signal suitable for dynamically driving said valve means at the output terminal.

22. Method according to claim 21, wherein it further comprising the step of:

measuring through a detection terminal a measured current value proportional to the current value present at the first output terminal of the first actuator circuit;

analyzing the measured current value and modulating the duty cycle of the first activation signal.

23. Method according to claim 22, wherein it furthermore comprises the following step of:

supplying a detector through said bias signal and activating said detector through an activation signal, generating a detection signal at a control terminal for controlling said pilot flame, and supplying a verification signal to said electrical unit.

24. Method according to claim 23, wherein said detection signal is a signal generated by means of an ionization flame detection principle.

25. Method according to claim 24, wherein said detection signal is an alternating signal.

26. Method according to claim 25, wherein it provides further the steps of:

activating said detection signal obtained by a voltage generator for a predetermined time window;

analyzing said verification signal by means of said electrical unit in the predetermined time window in order to verify a presence of the pilot flame.

27. Method according to claim 26, wherein it provides the step of:

deactivating said second command signal deactivating said spark circuit by means of said electrical unit;

dynamically driving said second actuator circuit by means of said second activation signal to generate the second drive signal suitable for dynamically driving said valve means at the output terminal.

28. Method according to claim 27, wherein it further comprises the following steps:

using said pilot flame in said pilot burner as ignition source of a main flame in a main burner;

activating the flame detection active at the pilot burner to detect said pilot flame through said detector.

29. Method according to claims 27, wherein it comprises a step of:

selecting a supply voltage to said automatic device using a selector circuit supplied by a first supply voltage supplied by the electricity main and by a second supply voltage to supply a third constant supply voltage to an output terminal.

* * * * *

UNITED STATES PATENT AND TRADEMARK OFFICE

CERTIFICATE OF CORRECTION

PATENT NO. : 8,123,517 B2
APPLICATION NO. : 11/981583
DATED : February 28, 2012
INVENTOR(S) : Lino Peruch It is certified that error appears in the above-identified patent and that said Letters Patent is hereby corrected as shown below:

- In Claim 1, Column 23, Line 24 of the patent, please change the text "one burners;" to --one burner;--.

- In Claim 21, Column 26, Line 6 of the patent, please change the text "supplying an spark circuit through said bias signal, activat-" to --supplying a spark circuit through said bias signal, activat- --.

- In Claim 22, Column 26, Line 16 of the patent, please change the text "prising the step of:" to --prises the step of:--.

- In Claim 29, Column 26, Line 55 of the patent, please change the text "Method according to claims 27, wherein it comprises a" to --Method according to claim 27, wherein it comprises a--.

Signed and Sealed this
Seventeenth Day of April, 2012

David J. Kappos

David J. Kappos
*Director of the United States Patent and Trademark Office*